US005462850A

United States Patent [19]

Asami et al.

[11] Patent Number: 5,462,850

[45] Date of Patent: Oct. 31, 1995

[54] SILVER HALIDE PHOTOGRAPHIC MATERIAL

[75] Inventors: Masahiro Asami; Naoto Ohshima; Shigeaki Otani, all of Minami-ashigara, Japan

[73] Assignee: Fuji Photo Film Co., Ltd., Kanagawa, Japan

[21] Appl. No.: 383,980

[22] Filed: Feb. 6, 1995

Related U.S. Application Data

[63] Continuation of Ser. No. 84,449, Jul. 1, 1993, abandoned, which is a continuation of Ser. No. 821,907, Jan. 15, 1992, abandoned, which is a continuation of Ser. No. 393,553, Aug. 14, 1989, abandoned, which is a continuation-in-part of Ser. No. 181,401, Apr. 14, 1988, abandoned.

[30] Foreign Application Priority Data

Apr. 17, 1987 [JP] Japan ..... 62-94931
Apr. 20, 1987 [JP] Japan ..... 62-97090

[51] Int. Cl.[6] ..... G03C 1/28

[52] U.S. Cl. ..... 430/569; 430/542; 430/570; 430/591; 430/592

[58] Field of Search ..... 430/542, 569, 430/570, 591, 592

[56] References Cited

U.S. PATENT DOCUMENTS

| | | | |
|---|---|---|---|
| 4,225,666 | 9/1980 | Locker et al. | 430/569 |
| 4,469,785 | 9/1984 | Tanaka et al. | 430/572 |
| 4,563,406 | 1/1986 | Ohbayashi et al. | 430/593 |
| 4,639,414 | 1/1987 | Sakaguchi | 430/550 |
| 4,683,193 | 7/1987 | Ihama et al. | 430/570 |
| 4,713,321 | 12/1987 | Mifune | 430/569 |
| 4,741,995 | 5/1988 | Tani | 430/558 |
| 4,791,053 | 12/1988 | Ogawa | 430/581 |
| 4,828,972 | 5/1989 | Ihama et al. | 430/569 |
| 4,925,777 | 5/1990 | Inoue et al. | 430/593 |

FOREIGN PATENT DOCUMENTS

| | | | |
|---|---|---|---|
| 64235 | 4/1982 | Japan | 430/593 |
| 58-184142 | 10/1983 | Japan . | |
| 60-80841 | 5/1985 | Japan . | |
| 60-203936 | 10/1985 | Japan . | |
| 61-103149 | 5/1986 | Japan . | |
| 61-196238 | 8/1986 | Japan . | |
| 62-103633 | 5/1987 | Japan . | |
| 62-250438 | 10/1987 | Japan . | |
| 62-253146 | 11/1987 | Japan . | |

*Primary Examiner*—Hoa Van Le
*Attorney, Agent, or Firm*—Birch, Stewart, Kolasch & Birch

[57] ABSTRACT

There is provided a silver halide photographic material which comprises silver chloride or silver chlorobromide substantially free from silver iodide. The silver halide photographic material is excellent in rapid processability, low in fogging, and high in sensitivity and contrast.

18 Claims, No Drawings

SILVER HALIDE PHOTOGRAPHIC MATERIAL

This application is a Rule 62 continuation of U.S. Ser. No. 08/084,449 filed on Jul. 1, 1993, now abandoned, which is a Rule 62 continuation of U.S. Ser. No. 07/821,907 filed Jan. 15, 1992, now abandoned, which is a Rule 62 continuation of U.S. Ser. No. 07/393,553 filed Aug. 14, 1989, now abandoned, which is a continuation-in-part application of Ser. No. 07/181,401 filed on Aug. 14, 1988, now abandoned, the entire contents of which are hereby incorporated by reference.

BACKGROUND OF THE INVENTION (a) Field of the Invention

The present invention relates to silver halide photographic materials, and more particularly to silver halide photographic materials excellent in rapid processability, low in fogging, and high in sensitivity and contrast.

(b) Description of the Prior Art

Currently commercially-available silver halide photographic materials (hereinafter referred to as photographic materials), and methods of forming images using them are various, and examples of their use can be found in a variety of fields. In many cases the composition of the silver halide emulsions used in these photographic materials consists of silver bromoiodide, silver bromochloride, or silver chlorobromide, these being mainly composed of silver bromide to provide high contrast.

Of the color photographic materials, especially regarding such products as photographic papers, used in a market where there is great demand for prints to be processed and delivered in a short time, to meet the requirement of increased developing speed, silver bromide or silver chlorobromide substantially free from iodide has been used. However, even in this case, many times silver bromide was used as a main component to obtain the required sensitivity.

In recent years the demand for rapid processability of color photographic paper has increased more and more, and many studies have therefore been made and some techniques to attain this rapid processability have been reported. In particular, it is well known that when the silver chloride content in a silver halide emulsion is increased, the developing speed can be remarkably improved. However, when an emulsion with a high silver content, that is, a so-called high-silver-chloride emulsion, is used, there is a tendency toward fogging, and it is difficult to obtain high sensitivity. Therefore, although the above technique is excellent in developing speed, there is a requirement to overcome these defects to make high-silver-chloride emulsions practical.

As mentioned above, the development of silver halide emulsions high in developing speed is one of the most important techniques for providing photographic materials that are adaptable to rapid processing, and to attain this it is necessary to provide high-silver-chloride emulsions with high sensitivity without causing fogging.

As techniques for increasing the sensitivity of silver chlorobromide emulsions high in silver chloride content, some reports can be found.

For example, Japanese Patent Application (OPI) Nos. 95736/1983 and 108533/1983 disclose techniques directed to high-silver-chloride emulsions that have a layered-type structure. According to Japanese Patent Application (OPI) No. 95736/1983, although an emulsion that can be subjected to rapid processing and is high in sensitivity can be obtained by allowing a layer mainly composed of silver bromide to be present inside the grains, it was found that in actual practice when pressure is applied to the emulsion grains, the desensitization becomes too great for the emulsion to be of practical use. Further, according to Japanese Patent Application (OPI) No. 108533/1983, although it is suggested that by locally-placing a layer composed mainly of silver bromide on the grain surface, an emulsion can be made that can be subjected to rapid processing, is high in sensitivity and wide in latitude of the chemical ripening, such disadvantages were found that in practice the toe of the characteristic curve is apt to become soft (in an extreme case, two-step gradation is observed), and further, that desensitization due to pressure is liable to occur. Further, Japanese Patent Application (OPI) Nos. 222844/1985 and 222845/1985 disclose techniques directed to high-silver-chloride emulsions provided with a layered-type structure. Even these techniques could not solve the above disadvantages.

Therefore, the problem that the sensitivity of silver chlorobromide emulsions having a high silver chloride content should be enhanced still remains an important theme.

Further, the performance required for these numerous photographic materials varies according to the particular application. It is necessary still to fully exhibit "high density recording", which is the most excellent characteristic of the advantages of photographic materials using silver halides, that is, the so-called silver salt photographic materials. Therefore, it goes without saying that the particular photographic material must be high in sharpness. Therefore, various techniques for enhancing sharpness have been developed in accordance with the level of sharpness required for the respective photographic material and the applied form of the photographic material, and these are applied in actual practice.

As factors in lowering the sharpness of photographic materials, two main points can be mentioned: halation due to the reflection of incident light at the emulsion layer/base interface or at the base/atmosphere interface; and irradiation due to the scattering of light by silver halide grains themselves.

To obviate lowering of the sharpness, for the former case, it is effective to provide an antihalation layer at the interface between the base and the emulsion layer or to the undersurface of the base, and for the latter case, it is effective to color the emulsion layer on the base with a dye or the like.

For the properties required for dyes for antihalation or anti-irradiation, the following must be satisfied:

(1) the dye has a spectral absorption suitable for the application;

(2) the dye can be eliminated quickly in photographic processing;

(3) the dye should not desensitize or fog the silver halide emulsion; and (4) the dye is stable during the production of the photographic material and during the storage of the produced photographic material. From these points of view, for example, oxonol-type dyes, and azo-type dyes are useful, and they are used in actual practice.

Generally most photographs used in the final form are images printed on photographic paper, and recently in particular the use of color photographic paper has become dominant. Although the sharpness of color images obtained as final items is, of course, largely dependent on the performance of the color negative film used, the sharpness of the color photographic paper on which the printing will be done also has a similarly large influence. That is, it can be said that, among performances required for color photographic paper, high sharpness is a very important item. For color photographic paper, since the reflective base has photographic emulsion layers thereon, it is possible to greatly enhance sharpness by preventing the irradiation mentioned above.

As can be understood from the above description, the market demand for photographic materials that can be processed rapidly and are high in sharpness is very strong. To meet this demand, one of the most important themes is that enhancement of the performance of silver halide photographic materials that have a photographic emulsion layer containing a silver chlorobromide emulsion or a silver chloride emulsion and a dye.

However, photographic materials having such a photographic emulsion layer highly change in sensitivity due to a change in humidity when exposed, and in many cases the color reproduction of a color image is remarkably deteriorated.

SUMMARY OF THE INVENTION

As is apparent from the above description, an object of the present invention is to provide a silver halide photographic material that is excellent in rapid processability, low in fogging, and high in sensitivity and contrast.

Another object of the present invention is to provide a silver halide photographic material excellent in sharpness and low in sensitivity due to a change in humidity when exposed.

A further object of the present invention is to provide a silver halide photographic material especially suitable for a color photographic paper that is excellent in rapid processability and sharpness, low in fogging, and low in the change in sensitivity due to a change in humidity when exposed, and high in sensitivity and contrast.

Other and further objects, features, and advantages of the invention will appear more evident from the following description.

DETAILED DESCRIPTION OF THE INVENTION

According to a preferred embodiment of the present invention, there is provided a silver halide photographic material having on a base at least one photosensitive emulsion layer containing a silver halide photographic emulsion, wherein said silver halide photographic emulsion comprises silver chlorobromide or silver chloride substantially free from silver iodide, and the step of preparing the silver halide photographic emulsion which comprises forming silver halide grains in the presence of a hydrophilic colloid, physical ripening, desalting, and chemical ripening, and in which a photographic spectral-sensitizing dye is added after the addition of at least 85 wt. % of a soluble silver salt solution, required for formation of silver halide grains, but before the desalting step.

According to another preferred embodiment of the present invention is the above-mentioned silver halide photographic material wherein the photographic material contains a layer on the base having at least one of the compounds represented by the formula (I), (II), or (III):

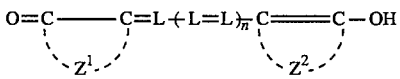

Formula (I)

wherein $Z^1$ and $Z^2$, which may be the same or different, each represent a group of nonmetal atoms required to form a heterocyclic ring, L represents a methine group, in which L and L may connect each other to form a ring, and n is 0, 1, or 2.

The heterocyclic rings formed by a group of nonmetal atoms represented by $Z^1$ and $Z^2$ are preferably 5- or 6-membered rings, which may be single rings or condensed rings, and examples of the heterocyclic rings include a 5-pyrazolone ring, barbituric acid, isooxazolone, thiobarbituric acid, rhodanine, imidazopyridine, pyrazolopyridine, and pyrrolidone, which may have a substituent.

Preferably the heterocyclic ring formed by $Z^1$ or $Z^2$ is barbituric acid or a 5-pyrazolone ring that has at least one sulfonic acid group or carboxylic acid group. Oxonol dyes having a pyrazolone nucleus or a barbituric acid nucleus are described, for example, in British Patent Nos. 506,385, 1,177,429, 1,311,884, 1,338,799, 1,385,371, 1,467,214, 1,433,102, and 1,553,516, Japanese Patent Application (OPI) Nos. 85130/1973, 114420/1984, 161233/1980, and 111640/1984, and U.S. Pat. Nos. 3,247,127, 3,469,985, and 4,078,933.

The methine group represented by L may have a substituent (e.g., an alkyl group preferably having 1 to 4 carbon atoms such as methyl or ethyl, an aryl group preferably having 6 to 10 carbon atoms such as phenyl, and a halogen atom such as chlorine), and the Ls may join together to form a ring (e.g. 4,4-dimethyl-1-cyclohexene).

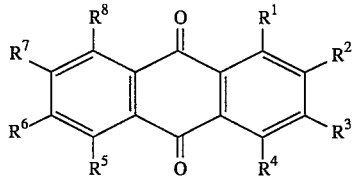

Formula (II)

wherein $R^1$, $R^4$, $R^5$ and $R^8$, which may be the same or different, each represent a hydrogen atom, a hydroxy group, an alkoxy group preferably having 1 to 4 carbon atoms, an aryloxy group preferably having 6 to 10 carbon atoms, a carbamoyl group, or an amino group

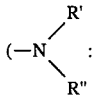

in which R' and R" which may be the same or different, each represent a hydrogen atom, an aryl group preferably having 6 to 10 carbon atoms, or an alkyl group preferably having 1 to 4 carbon atoms, $R^2$, $R^3$, $R^6$, and $R^7$, which may be the same or different each represent a hydrogen atom, a sulfonic acid group, a carboxyl group, an aryl group preferably having 6 to 10 carbon atoms or alkyl group preferably having 1 to 4 carbon atoms.

$R^2$, $R^3$, $R^6$, $R^7$, R' and R" have at least one sulfonic acid group or carboxylic acid group when they represent an alkyl group or aryl group. Formula (III)

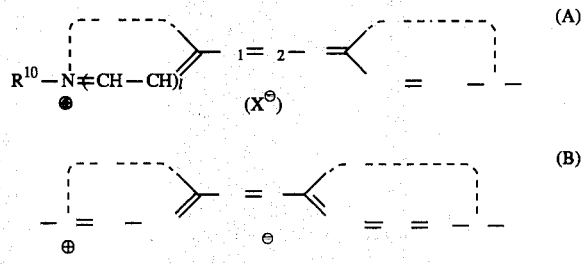

wherein $R^{10}$ and $R^{11}$, which may be the same or different, each represent a substituted or unsubstituted alkyl group preferably having 1 to 8 carbon atoms, $L_1$, $L_2$, and $L_3$, which may be the same or different, each represent a substituted or unsubstituted methine group, as mentioned above, m is 0, 1, 2, or 3, $L_1$ and $R^{11}$, $L_3$ and $R^{11}$, $L_2$ and $L_2$ when m is 2, and $L_1$ and $L_1$ when m is 3, may connect each other to form a ring, and preferred ring which is formed by connecting $L_2$ and $L_2$, when m is 2, for example, is a 6-membered carbon ring.

Z and Z', which may be the same or different, each represent a group of nonmetal atoms required for forming a substituted or unsubstituted heterocyclic 5- or 6-membered ring, and l and n each are 0 or 1, $X^{\ominus}$ represents an anion, and p is 1 or 2, provided that if the compound forms an inner salt, p is 1.

Details of the above cyanine dyes are described, for example, in U.S. Pat. Nos. 2,843,486 and 3,294,539.

According to conventional techniques, generally, spectral sensitizing dyes are added to an emulsion that has been chemically sensitized before the emulsion is applied. However, the effect of the present invention cannot be obtained that way. For example, in U.S. Pat. No. 4,425,426, a method is disclosed wherein a spectral sensitizing dye is added immediately before the start of chemical sensitization or during chemical sensitization. However, even if this method is followed, the effect of the present invention cannot be obtained. Further, U.S. Pat. Nos. 2,735,766, 3,628,960, 4,183,756, and 4,225,666 disclose methods wherein spectral sensitizing dyes are added to emulsions before the completion of formation of silver halide grains. Of these, particularly U.S. Pat. Nos. 4,183,756 and 4,225,666 describe that by adding a spectral-sensitizing dye to an emulsion after the formation of stable nuclei in the formation of silver halide grains, but before the addition of 85 wt. % of a silver salt solution, enhancement of the photographic sensitivity and enhancement of adsorption of the spectral-sensitizing dye onto the silver halide grains can be achieved. However, such an addition method is troublesome, and it was furthermore found that there is a problem in that the size distribution and the form of the silver halide grains formed vary remarkably, which blemishes the photographic performance of the resulting emulsion.

In any rate, the effect of the present invention, that by adding a spectral-sensitizing dye to an emulsion after the addition of at least 85 wt. % of a soluble silver salt solution but during the formation of silver halide grains, a silver chlorobromide emulsion having a higher silver chloride content (95 mol % or more) can be provided with high sensitivity and that fogging can be remarkably decreased, is a new finding that could not be entirely expected from prior known publications.

In the present invention, in the preparation of silver halide emulsion grains, it is required to add a spectral-sensitizing dye after the addition of at least 85 wt. % of a soluble silver salt solution, but during the time silver halide grains are being formed. If the spectral-sensitizing dye is added earlier than that, it causes problems such as, for example, that the shape of the silver halide grains becomes irregular and the grain size distribution becomes wide. Further, if the spectral-sensitizing dye is added substantially after forming silver halide grains, it is not adequate because the effect of the present invention for providing high sensitivity is much less.

In this specification and claims expression "during time silver halide grains are being formed" means a period until the completion of addition of the soluble silver salt solution, including the point immediately after the completion of addition. The expression "immediately after" means a time period of within one minute, preferably 30 seconds, after the completion of addition.

Spectral-sensitizing dyes used in the present invention that can be mentioned include cyanine dyes, merocyanine dyes, composite cyanine dyes, composite merocyanine dyes, halopolar cyanine dyes, hemicyanine dyes, styryl dyes, and hemioxonol dyes. Of these, particularly preferable are cyanine dyes, merocyanine dyes, and composite cyanine dyes.

Examples of the preferred cyanine dyes include those represented by the above-mentioned (A) and (B) in Formula (III). As the preferred merocyanine dyes may be mentioned dyes represented by the following Formula (C):

Formula (C)

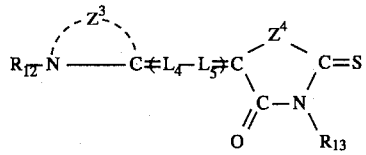

wherein $R_{12}$ has the same meaning as $R^{10}$ or $R^{11}$ in formula (A) or (B), $R_{13}$ represents the same groups as $R_{12}$ or represents a hydrogen atom, a furfuryl group, or a single ring-aryl group, $Z^3$ has the same meaning as Z or $Z^1$, $Z^4$ represents a sulfur atom, an oxygen atom, a selenium atom, or N—$R_{14}$ wherein $R_{14}$ represents a hydrogen atom, pyridyl group, a phenyl group, a substituted phenyl group, or an aliphatic hydrocarbon group having carbon atoms of 8 or less, which may contain an oxygen atom, a sulfur atom or a nitrogen atom in the carbon chain and may have a substituent, $L_4$ and $L_5$ has the same meaning as $L_1$, $L_2$ or $L_3$, and m is 0, 1, or 2.

Examples of the sensitizing dyes employed in the present invention include the dyes represented by formula (IV), (V), (VI), (VII), (VIII) or (IX).

Formula (IV) is as follows:

(IV)

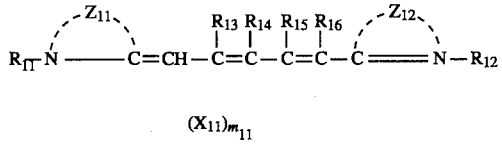

wherein $Z_{11}$ represents an atomic group necessary to form a benzoxazole nucleus, a naphthoxazole nucleus, a benzothiazole nucleus, a naphthothiazole nucleus, a dihydronaphthothiazole nucleus, a benzoselenazole nucleus, a naphthoselenazole nucleus, a dihydronaphthoselenazole nucleus; $Z_{12}$ represents an atomic group necessary to form a benzothiazole nucleus, a naphthothiazole nucleus, a dihydronaphthothiazole nucleus, a benzoselenazole nucleus, a naphthoselenazole nucleus or a dihydronaphthoselenazole nucleus; with the proviso that the nitrogen-containing heterocyclic nuclei represented by $Z_{11}$ and $Z_{12}$ may optionally have one or more substituents.

Preferred examples of the substituents on $Z_{11}$ and $Z_{12}$ include a lower alkyl group (more preferably an alkyl group having 6 or less carbon atoms), a lower alkoxy group (more preferably an alkoxy group having 6 or less carbon atoms), a chlorine atom, a lower alkoxycarbonyl group (more preferably an alkoxycarbonyl group having 5 or less carbon atoms), an optionally substituted phenyl group (e.g., a phenyl group, a tolyl group, an anisyl group, a chlorophenyl group, etc.) or a hydroxyl group.

Typical examples of the nitrogen-containing heterocyclic groups represented by $Z_{11}$ and $Z_{12}$ are, for example, a 5-hydroxybenzoxazole group, a 5-methoxybenzoxazole group, a ethoxybenzoxazole group, a 5-phenylbenzoxazole group, a 5,6 -dimethylbenzoxazole group, a 5-methyl-6-methoxybenzoxazole group, a 6-ethoxy-5-hydrobenzoxazole group, a naphtho[1,2-d] oxazole group, a naphtho[2,3-d]oxazole group, a naphtho[2,1-d] oxazole group, a 5-methyl benzothiazole group, a 5-methoxybenzothiazole group, a 5-ethylbenzothiazole group, a 5,p-tolylbenzothiazole group, a 6-methyl benzothiazole group, a 6-ethylbenzothiazole group, a 6-butylbenzothiazole group, a 6-methoxybenzothiazole group, a 6-butoxybenzothiazole group, a 5,6-dimethylbenzothiazole group, a 5,6-dimethoxybenzothiazole group, a 5-hydroxy-6-methyl benzothiazole group, a 5-ethoxycarbonylbenzothiazole group, a 5-chlorobenzothiazole group, 5-5-chloro-6-methylbenzothiazole group, "a naphtho-[ 1,2-d]thiazole group, a naphtho[2,1-d] thiazole group, a 5-methylnaphtho[2,1-d]thiazole group, an 8,9-dihydronaphtho-[ 1,2-d]thiazole group, an 8-methoxynaphtho [1,2-d]thiazole group, a benzothiazole group, a benzoselenazole group, a 5-methoxybenzoselenazole group, a 6-methylbenzoselenazole group, a 5-methoxybenzoselenazole group, a 6-methoxybenzoselenazole group, a 5,6-dimethylbehzoselenazole group, a 5-ethoxy- 6-methylbenzoselenazole group, a 5-hydroxy-6-methylbenzoselenazole group, a naphtho[1,2-d]selenazole group, a naphtho[2,1-d] selenazole group, etc.

$R_{11}$ and $R_{12}$ in formula (IV) may be the same or different, and each represents an alkyl group or alkenyl group which has 10 or less carbon atoms and which can optionally be substituted. Suitable substituents on the alkyl or alkenyl group include, for example, a sulfo group and an alkoxy group having 6 or less carbon atoms, a halogen atom, a hydroxyl group, an optionally substituted aryl group having 8 or less carbon atoms (e.g., a phenyl group, a furyl group, a thienyl group, a tolyl group, a p-butylphenyl group, a xylyl group, an anisyl group, a sulfophenyl group, a hydroxyphenyl group, a carboxyphenyl group, a chlorophenyl group, etc.), a phenoxy group which has 8 or less carbon atoms and which may optionally be substituted (for example, by one or more substituents selected from a fluorine atom, a chlorine atom, a sulfo group, a hydroxyl group, a carboxyl group, an alkoxycarbonyl group,-an alkyl group, an alkoxy group, etc.), an acyl group having 8 or less carbon atoms (e.g., a phenylsulfonyl group, a tosyl group, a methylsulfonyl group, a benzoyl group, an acetyl group, a propionyl group, etc.), an alkoxycarbonyl group having 6 or less carbon atoms, a carboxyl group, etc.

$R_{13}$ and $R_{15}$ in formula (IV) each represents a hydrogen atom. Alternatively, $R_{13}$ may be linked with $R_{15}$ to form a 5- or 6-membered ring. When $R_{13}$ is linked with $R_{15}$ to form a 5- or 6-membered ring, $R_{14}$ represents a hydrogen atom. Alternatively, when $R_{13}$ and $R_{15}$ both are hydrogen atom, $R_{14}$ represents an alkyl group having 4 or less carbon atoms or a phenylalkyl group having 10 or less carbon atoms.

More preferably, $R_{14}$ represents a hydrogen atom, $R_{13}$ is linked with $R_{15}$ to form a 5- or 6-membered ring; or $R_{13}$ and $R_{15}$ both are hydrogen atoms, and $R_{14}$ represents an alkyl group having 4 or less carbon atoms or a benzyl group.

$R_{16}$ represents a hydrogen atom or may be linked with $R_{12}$ to form a 5- or 6-membered carbon ring.

Among the nitrogen-containing heterocyclic nucleus-forming atomic groups represented by $Z_{11}$, more preferred heterocyclic nuclei are napthoxazoles, benzothiazoles having at least one electron-donating group with a negative Hammett's σp value, dihydronaphthothiazoles, naphthothiazoles and benzoselenazoles.

$X_{11}^{\ominus}$ in formula (IV) represents an acid anion residue; and $m_{11}$ represents 0 or 1, and when the compound of formula (IV) is an internal salt, $m_{11}$ is 0.

Formula (V) is as follows:

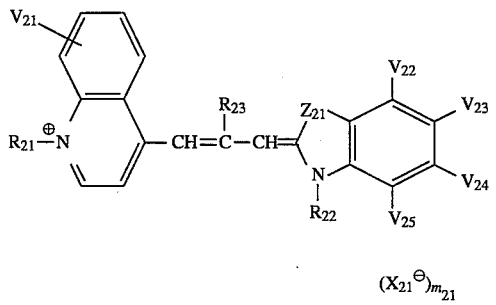

(V)

wherein $Z_{21}$ represents a sulfur atom or a selenium atom;

$R_{21}$ and $R_{22}$ have the same definition as $R_{11}$ or $R_{12}$ in formula (IV); with the proviso that at least one of them must contain a sulfo group or a carboxyl group;

$R_{23}$ represents a hydrogen atom or a lower alkyl group having 4 or less carbon atoms;

$V_{21}$ represents a hydrogen atom, an alkyl group having 6 or less carbon atoms, an alkoxy group having 6 or less carbon atoms, a fluorine atom or a hydroxyl group;

$V_{22}$ and $V_{25}$ each represents a hydrogen atom;

$V_{23}$ represents a hydrogen atom, a lower alkyl group (preferably an alkyl group having 6 or less carbon atoms), a lower alkoxy group (preferably an alkoxy group having 6 or less carbon atoms) or a hydroxyl group;

$V_{24}$ represents a hydrogen atom, a lower alkyl group (preferably an alkyl group having 6 or less carbon atoms), a lower alkoxy group (preferably an alkoxy group having 6 or less carbon atoms), a chlorine atom, a lower alkoxycarbonyl group, an optionally substituted phenyl group (e.g., a phenyl group, a tolyl group, an anisyl group, etc.) or a hydroxyl group;

$V_{22}$ and $V_{23}$, $V_{23}$ and $V_{24}$, and $V_{24}$ and $V_{25}$ may be linked together to form a condensed benzene ring, which may be optionally substituted. Examples of suitable substituents on the condensed benzene ring include a chlorine atom, a lower alkyl group (preferably having 4 or less carbon atoms), a lower alkoxy group (preferably having 4 or less carbon atoms), etc.

The most preferred of the nitrogen-containing heterocyclic nuclei which contain $Z_{21}$, are a naphtho[1,2-d] thiazole nucleus, a naphtho [2,1-d]thiazole nucleus, a naphtho[1,2-d]selenazole nucleus, a naphtho[2,1-d]selenazole nucleus or benzoselenazole nuclei having at least one electron-donating group with a negative Hammett's σp value.

In formula (V), $X_{21}^{\ominus}$ represents an acid anion residue, whereas $m_{21}$ represents 0 or 1 with the proviso that when the compound of formula (V) forms an internal salt, $m_{21}$ is 0.

Formula (VI) is as follows:

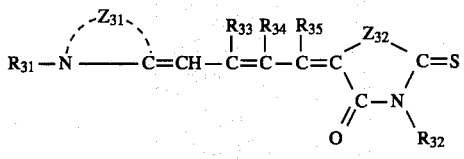

(VI)

wherein $Z_{31}$ has the same definition as $Z_{12}$ in formula (IV) or $Z_{31}$ represents an atomic group capable of forming a naphthoxazole nucleus, and may optionally have one or more substituents selected from substituents referred to above for the nitrogen-containing heterocyclic nuclei represented by $Z_{11}$ or $Z_{12}$ in formula (IV);

$Z_{32}$ represents a sulfur atom, a selenium atom or >N—$R_{36}$, wherein $R_{36}$ represents a hydrogen atom, a pyridyl group, a phenyl group, a substituted phenyl group (e.g., a tolyl group, an anisyl group, a hydroxyphenyl group, etc.) or an aliphatic hydrocarbon residue which may contain an oxygen atom, a sulfur atom or a nitrogen atom in the carbon chain and which may be substituted By one or more substituents selected from a hydroxyl group, a halogen atom, an alkylaminocarbonyl group, an alkoxycarbonyl group and a phenyl group, the total number of carbon atoms in the aliphatic hydrocarbon residue being 8 or less; more preferably $R_{36}$ represents a hydrogen atom, a phenyl group, a pyridyl group or an alkyl group which may contain an oxygen atom in the carbon chain and which may have a hydroxyl group;

$R_{31}$ has the same meaning as $R_{11}$ or $R_{12}$ in formula (IV);

$R_{32}$ has the same meaning as $R_{11}$ or $R_{12}$ in formula (IV)or $R_{32}$ represents a hydrogen atom, a furfuryl group or an optionally substituted mono-cyclic aryl group (e.g., a phenyl group, a tolyl group, an anisyl group, a carboxyphenyl group, a hydroxyphenyl group, a chlorophenyl group, a sulfophenyl group, a pyridyl group, a 5-methyl-2-pyridyl group, a 5-chloro- 2-pyridyl group, a furyl group or a thienyl group);

$R_{33}$ and $R_{35}$ each represents a hydrogen atom, or $R_{33}$ and $R_{35}$ may be linked together to form a 5- or 6-membered ring;

$R_{34}$ has the same meaning as $R_{14}$ in formula (IV);

with the proviso that at least one of $R_{31}$ and $R_{34}$ does not contain a sulfo group and the other is a group containing a sulfo group or a carboxyl group.

The present invention, described in further detail below, thus provides a silver halide color photographic material which contains a high silver chloride emulsion and which has been spectrally sensitized by a spectral sensitizing dye represented by the above-mentioned general formula (IV), (V) or (VI), wherein the photographic material is able to be subjected to color-development with a color developer which substantially excludes benzyl alcohol and which contains bromide ion in an amount of about 0.002 mol/liter or less for a short period of time of about 2 minutes and 30 seconds or less and then is successively processed with a blix solution having pH of about 6.5 or less, more preferably a pH of 6.0 or less, for a period of time of about 75 seconds or less, even possibly for a shorter period of time of 60 seconds or less, resulting in the formation of color images.

Formula (VII) is as follows:

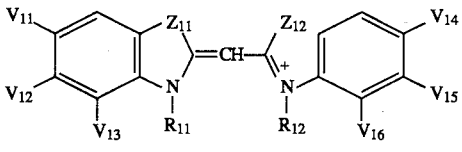

(VII)

In the above general formula (VII), $Z_{11}$ represents an oxygen atom, a sulfur atom or a selenium atom.

$Z_{12}$ represents a sulfur atom or a selenium atom.

$R_{11}$ and $R_{12}$ which may be the same or different, each represents an optionally substituted alkyl group or alkenyl group containing up to 6 carbon atoms, with at least one of $R_{11}$ and $R_{12}$ being a sulfo-substituted alkyl group. Most preferably, at least one of $R_{11}$ and $R_{12}$ represents a 3-sulfopropyl group, a 2-hydroxy-2-sulfopropyl group, a 3-sulfobutyl group, or a sulfoethyl group. Examples of suitable substituents include an alkoxy group containing up to 4 carbon atoms, a halogen atom, a hydroxy group, a carbamoyl group, a phenyl group which may be optionally substituted and which contains up to 8 carbon atoms, a carboxy group, a sulfo group, and an alkoxycarbonyl group containing up to 5 carbon atoms. Specific examples of $R_{11}$ and $R_{12}$ include a methyl group, an ethyl group, a propyl group, an allyl group, a pentyl group, a hexyl group, a methoxyethyl group, an ethoxyethyl group, a phenethyl group, a 2-p-tolylethyl group, a 2-p-sulfophenethyl group, a 2,2,2-trifluoroethyl group, a 2,2,3-tetrafluoropropyl group, a carbamoylethyl group, a hydroxyethyl group, a 2-(2-hydroxyethoxy)ethyl group, a carboxymethyl group, a carboxyethyl group, an ethoxycarbonylmethyl group, a 2-sulfoethyl group, a 2-chloro-3-sulfopropyl group, a 3-sulfopropyl group, a 2-hydroxy-3-sulfopropyl group, a 3-sulfobutyl group, a 4-sulfobutyl group, etc.

When $Z_{11}$ represents an oxygen atom, $V_{11}$ and $V_{13}$ each represents a hydrogen atom, and $V_{12}$ represents a phenyl group or a phenyl group substituted by an alkyl group or an alkoxy group containing up to 3 carbon atoms or a chlorine atom (particularly preferably a phenyl group), or $V_{11}$ and $V_{12}$, or $V_{12}$ and $V_{13}$, may be linked to each other to form a fused benzene ring. Most preferably, $V_{11}$ and $V_{13}$ each represents a hydrogen atom, and $V_{12}$ represents a phenyl group.

When $Z_{11}$ represents a sulfur atom or a selenium atom, $V_{11}$ represents an alkyl group or an alkoxy group containing up to 4 carbon atoms or a hydrogen atom, $V_{12}$ represents an alkyl group containing up to 5 carbon atoms, an alkoxy group containing up to 4 carbon atoms, a chlorine atom, a hydrogen atom, an optionally substituted phenyl group (e.g., a tolyl group, an anisyl group, a phenyl group, etc.) or a hydroxy group, and $V_{13}$ represents a hydrogen atom, or $V_{11}$ and $V_{12}$, or $V_{12}$ and $V_{13}$, may be linked to each other to form a fused benzene ring. More preferably, $V_{11}$ and $V_{13}$ each represents a hydrogen atom and $V_{12}$ represents an alkoxy group containing up to 4 carbon atoms, a phenyl group or a chlorine atom; $V_{11}$ represents an alkoxy group or an alkyl group containing up to 4 carbon atoms and $V_{12}$ represents a hydroxy group or an alkyl group containing up to 4 carbon atoms; or $V_{12}$ and $V_{13}$ are linked to each other to form a fused ring.

When $Z_{12}$ represents a selenium atom, $V_{14}$, $V_{15}$, and $V_{16}$ are respectively the same as defined for $V_{11}$, $V_{12}$, and $V_{13}$ in connection with the case where $Z_{11}$ represents a selenium atom. When $Z_{12}$ represents a sulfur atom and $Z_{11}$ represents a selenium atom, $V_{14}$ represents a hydrogen atom, an alkoxy group containing up to 4 carbon atoms or an alkyl group containing up to 5 carbon atoms, $V_{15}$ represents an alkoxy group containing up to 4 carbon atoms, an optionally substituted phenyl group (preferably a phenyl group; exemplified by a tolyl group and an anisyl group), an alkyl group containing up to 4 carbon atoms, a chlorine atom or a hydroxy group, and $V_{16}$ represents a hydrogen atom, or $V_{14}$ and $V_{15}$, or $V_{15}$ and $V_{16}$, may be linked to each other to form a fused benzene ring.

More preferably, $V_{14}$ and $V_{16}$ each represents a hydrogen atom, and $V_{15}$ represents an alkoxy group containing up to 4 carbon atoms, a chlorine atom or a phenyl group; or $V_{15}$ and $V_{16}$ are linked to each other to form a fused benzene fing. When $Z_{11}$ and $Z_{12}$ both represent a sulfur atom, $V_{14}$ and $V_{16}$ each represents a hydrogen atom and $V_{15}$ represents an optionally substituted phenyl group (e.g., a phenyl group or a tolyl group), or $V_{14}$ represents a hydrogen atom and $V_{15}$ and $V_{16}$ are linked to each other to form a fused benzene ring. When $Z_{11}$ represents an oxygen atom and $Z_{12}$ represents a sulfur atom, $V_{14}$ and $V_{16}$ each represents a hydrogen atom, and $V_{15}$ represents a chlorine atom, an optionally substituted phenyl group or an alkoxy group containing up to 4 carbon atoms, or $V_{15}$ and $V_{16}$ may be linked to each other to form a fused benzene ring; more preferably, $V_{14}$ and $V_{16}$ each represents a hydrogen atom and $V_{15}$ represents a phenyl group, or $V_{15}$ and $V_{16}$ are linked to each other to form a fused benzene ring.

$X_{11}$ represents a counter ion which is required to neutralize a charge on a cyanine dye of formula (VII) or (VIII). Examples of these ions are a halogen ion such as $Cl^-$, $Br^-$, $I^-$, etc.;

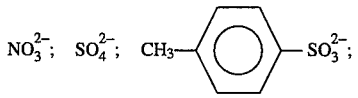

Rhodan ion, etc., as an anion; and an alkali metal ion such as $Li^+$, $Na^+$, $K^+$, etc.; an alkali earth metal ion such as $Ca^{2+}$, etc, as a cation.

$m_{11}$ represents 0 or 1 and, in the case of forming inner salt, $m_{11}$ represents 1.

Formula (VIII) is as follows:

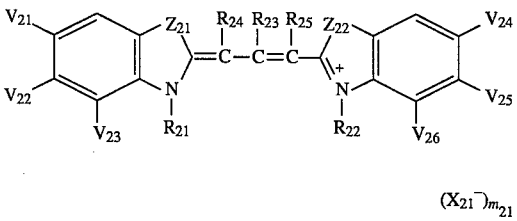

(VIII)

In the above general formula (VIII), $Z_{21}$ represents an oxygen atom, a sulfur atom, a selenium atom, or >N—$R_{26}$, and $Z_{22}$ represents an oxygen atom or >N—$R_{27}$.

$R_{21}$ and $R_{22}$ are the same as defined for $R_{11}$ or $R_{12}$ in general formula (VII),or $R_{21}$ and $R_{24}$, or $R_{22}$ and $R_{25}$, may be linked to each other to form a 5- or 6-membered carbon ring.

$R_{23}$ represents a hydrogen atom when at least one of $Z_{21}$ and $Z_{22}$ represents >N—$R_{26}$, or represents an ethyl group, a propyl group or a butyl group (preferably an ethyl group) in other cases. $R_{24}$ and $R_{25}$ each represents a hydrogen atom.

$R_{26}$ and $R_{27}$ are the same as defined for $R_{11}$ in general formula (VII), provided that $R_{21}$ and $R_{26}$, and $R_{22}$ and $R_{27}$, do not represent a sulfo group-containing substituent at the same time.

$V_{21}$ represents a hydrogen atom when $Z_{21}$ represents an oxygen atom, or represents a hydrogen atom, an alkyl group containing up to 5 carbon atoms or an alkoxy group containing up to 5 carbon atoms when $Z_{21}$ represents a sulfur atom or a selenium atom, or represents a hydrogen atom or a chlorine atom when $Z_{21}$ represents >N—$R_{26}$.

$V_{22}$ represents a hydrogen atom, an alkyl group containing up to 5 carbon atoms, an alkoxy group containing up to 5 carbon atoms, a chlorine atom or an optionally-substituted phenyl group (e.g., a tolyl group, an anisyl group, a phenyl group, etc.), or $V_{22}$ may be bonded to $V_{21}$ or $V_{23}$ to form a fused benzene ring when $Z_{21}$ represents an oxygen atom and $Z_{22}$ represents >N—$R_{27}$ (more preferably $V_{22}$ represents an alkoxy group or a phenyl group, or $V_{21}$ and $V_{22}$, or $V_{22}$ and $V_{23}$ are linked to each other to form a fused benzene ring), or $V_{22}$ represents an optionally substituted phenyl group (e.g., a tolyl group, an anisyl group, a phenyl group, etc., with a phenyl group being more preferable) or may be linked to $V_{21}$ or $V_{23}$ to form a fused benzene ring when $Z_{21}$ and $Z_{22}$ both represent an oxygen atom, or $V_{22}$ represents a hydrogen atom, an alkyl group containing up to 5 carbon atoms, an alkoxycarbonyl group containing up to 5 carbon atoms, an alkoxy group containing up to 4 carbon atoms, an acylamino group containing up to 4 carbon atoms, a chlorine atom or an optionally substituted phenyl group (more preferably an alkyl group or an alkoxy group containing up to 4 carbon atoms, a chlorine atom or a phenyl group) when $Z_{21}$ represents a sulfur atom or a selenium atom, or may be bonded to $V_{23}$ to form a fused benzene ring when $Z_{21}$ represents a sulfur atom. When $Z_{21}$ represents >N—$R_{26}$, $V_{22}$ represents a chlorine atom, a trifluoromethyl group, a cyano group, an alkylsulfonyl group containing up to 4 carbon atoms or an alkoxycarbonyl group containing up to 5 carbon atoms (preferably $V_{21}$ represents a chlorine atom and $V_{22}$ represents a chlorine atom, a trifluoromethyl group or a cyano group when $Z_{21}$ represents >N—$R_{26}$).

$V_{24}$ represents a hydrogen atom when $Z_{22}$ represents an oxygen atom, or represents a hydrogen atom or a chlorine atom when Z represents >N—$R_{27}$.

$V_{25}$ represents an alkoxy group containing up to 4 carbon atoms, a chlorine atom or an optionally substituted phenyl group (e.g., a n anisyl group, a tolyl group, a phenyl group, etc.) or may be bonded to $V_{24}$ or $V_{26}$ to form a fused benzene ring when $Z_{22}$ represents an oxygen atom and, more preferably an alkoxy group containing up to 4 carbon atoms, a phenyl group or is preferably bonded to $V_{24}$ or $V_{26}$ to form a fused benzene ring when Z 21 represents >N—$R_{26}$, or $V_{25}$ preferably represents a phenyl group or is preferably bonded to $V_{24}$ or $V_{26}$ to form a fused benzene ring when $Z_{21}$ represents an oxygen atom, a sulfur atom or a selenium atom. When $Z_{22}$ represents >N—$R_{27}$, $V_{25}$ represents a chlorine atom, a trifluoromethyl group, a cyano group, an alkylsulfonyl group containing up to 4 carbon atoms or a carboxyalkyl group containing up to 5 carbon atoms. Particularly preferably, $V_{24}$ represents a chlorine atom, and $V_{25}$ represents a chlorine atom, a trifluoromethyl group or a cyano group.

$V_{26}$ represents a hydrogen atom.

$X_{21}$ represents a counter ion which is required to neutralize a charge on a cyanine dye of formula (VII) or (VIII). Examples of these ions are a halogen ion such as $Cl^-$, $Br^-$, $I^-$, etc.;

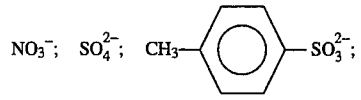

Rhodan ion, etc., as an anion; and an alkali metal ion such as $Li^+$, $Na^+$, $K^+$, etc.; an alkali earth metal ion such as $Ca^{2+}$, etc, as a cation.

$m_{21}$ represents 0 or 1 and, when an inner salt is formed, $m_{21}$ represents 0.

Formula (IX) is as follows:

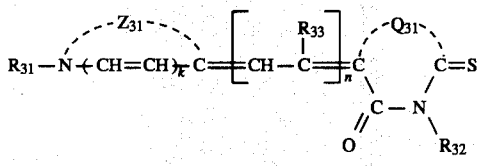

(IX)

In the above general formula (IX), $Z_{31}$ represents atoms forming a heterocyclic nucleus of thiazoline, thiazole, benzothiazole, naphthothiazole, selenazoline, selenazole, benzoselenazole, naphthoselenazole, benzimidazole, naphthoimidazole, oxazole, benzoxazole, naphthoxazole, or pyridine, with the heterocyclic nucleus being optionally substituted. When $Z_{31}$ represents &toms forming a benzimidazole nucleus or a naphthoimidazole nucleus, substituents for the nitrogen atom at the 1-position other than $R_{31}$ include those illustrated for $R_{26}$ or $R_{27}$ of general formula (VII) described above. Substituents in the fused benzene ring of benzimidazole include, for example, a chlorine atom, a cyano group, an alkoxycarbonyl group containing up to 5 carbon atoms, an alkylsulfonyl group containing up to 4 carbon atoms or a trifluoromethyl group. Particularly preferably, the benzimidazole nucleus is substituted by a chlorine atom at the 5-position and by a cyano group, a chlorine atom or a trifluoromethyl group at the 6-position. Substituents for heterocyclic nuclei other than the benzimidazole nucleus, selenazoline nucleus, and thiazoline nucleus include an optionally substituted alkyl group containing a total of up to 8 carbon atoms (examples of the substituents being a hydroxy group, a chlorine atom, a fluorine atom, an alkoxy group, a carboxy group, an alkoxycarbonyl group, a phenyl group or a substituted phenyl group), a hydroxy group, an alkoxycarbonyl group containing up to 5 carbon atoms, a halogen atom, a carboxy group, a furyl group, a thienyl group, a pyridyl group, a phenyl group or a substituted phenyl group (e.g., a tolyl group, an anisyl group, a chlorophenyl group, etc.). Substituents for the selenazoline nucleus or thiazoline nucleus include an alkyl group containing up to 6 carbon atoms, a hydroxyalkyl or alkoxycarbonylalkyl group containing up to 5 carbon atoms, etc.

$R_{31}$ is the same as defined above for $R_{11}$ or $R_{12}$ in general formula (VII).

$R_{32}$ is the same as defined above for $R_{11}$ or $R_{12}$ in general formula (VII), or represents a hydrogen atom, a furfuryl group or an optionally substituted aryl group (e.g., a phenyl group, a tolyl group, an anisyl group, a carboxyphenyl group, a hydroxyphenyl group, a chlorophenyl group, a sulfophenyl group, a pyridyl group, a 5-methyl-2-pyridyl group, a 5-chloro-2-pyridyl group, a thienyl group, a furyl group, etc.), provided that at least one of $R_{31}$ and $R_{32}$ represents a substituent having a sulfo or carboxy group and the other represents a substituent having no sulfo group.

$R_{33}$ represents a hydrogen atom, an alkyl group containing up to 5 carbon atoms, a phenethyl group, a phenyl group or a 2-carboxyphenyl group, more preferably a hydrogen atom, a methyl group or an ethyl group.

$Q_{31}$ represents an oxygen atom, a sulfur atom, a selenium atom or >N—$R_{34}$, provided that, when $Z_{31}$ represents atoms forming a thiazoline, selenazoline or oxazole nucleus, $Q_{31}$ preferably represents a sulfur atom, a selenium atom or >N—$R_{34}$.

$R_{34}$ represents a hydrogen atom, a pyridyl group, a phenyl group, a substituted phenyl group (e.g., a tolyl group, an anisyl group, etc.), or an aliphatic hydrocarbyl group optionally containing an oxygen atom, a sulfur atom or a nitrogen atom in the carbon chain, optionally having a substituent or substituents, and containing a total of up to 8 carbon atoms.

k represents 0 or 1, and n represents 0 or 1.

When n represents 1 and $Z_{31}$ represents atoms forming a pyridine nucleus, $Q_{31}$ represents an oxygen atom.

Although the amount of these spectral sensitizing dyes to be added may vary within a wide range depending on the particular case, preferably the amount is in the range of $1.0\times10^{-6}$ to $1.0\times10^{-2}$ per mol of a silver halide, more preferably in the range of $1.0\times10^{-5}$ to $1.0\times10^{-3}$.

To add these spectral sensitizing dyes in the step of the preparation of the emulsion, usual methods can be followed. That is, the dye used is dissolved in a suitable organic solvent (e.g., methanol, ethanol, and ethyl acetate) to form a solution having a suitable concentration, and the solution may be added to the emulsion. Alternatively, the dye used can be added as an aqueous dispersion formed by, for example, dispersing the dye into an aqueous solution using, for example, a surface-active agent, or by dispersing the dye into an aqueous gelatin solution having a suitable concentration.

Specific examples of the spectral sensitizing dyes that can be used in the present invention are shown below, but the invention is not limited to them:

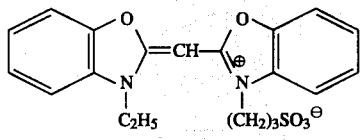

S-1

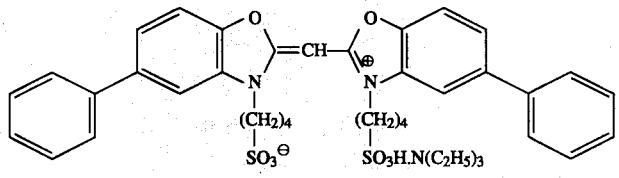

S-2

-continued
S-3
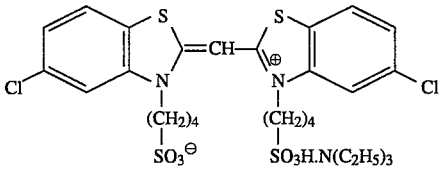
S-4
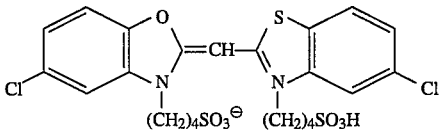
S-5
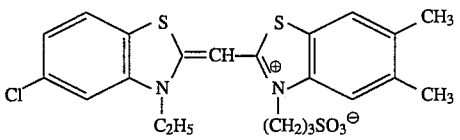
S-6
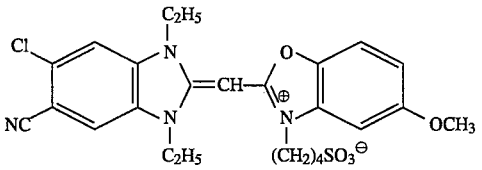
S-7
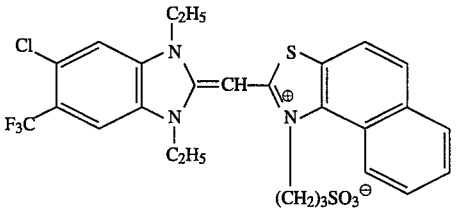
S-8
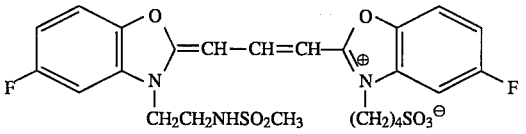
S-9
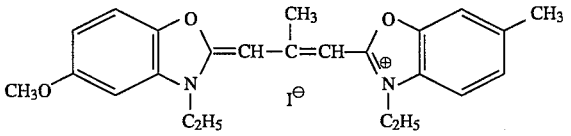
S-10
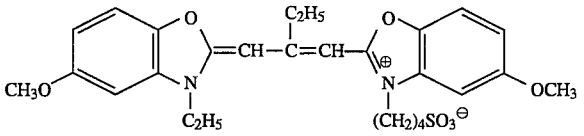
S-11
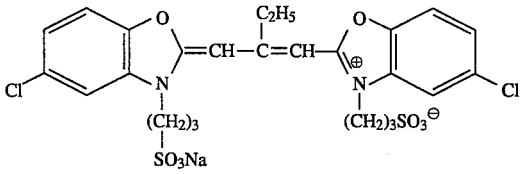
S-12
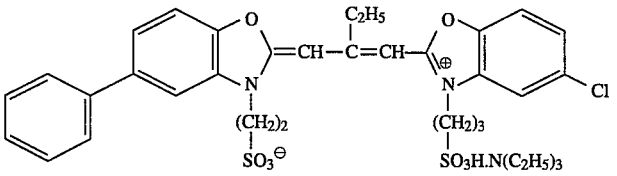

-continued
S-13
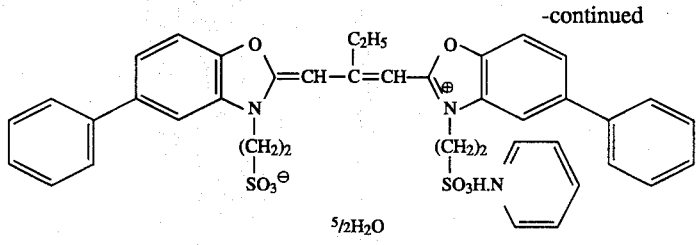
S-14
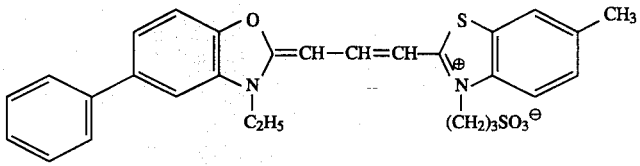
S-15
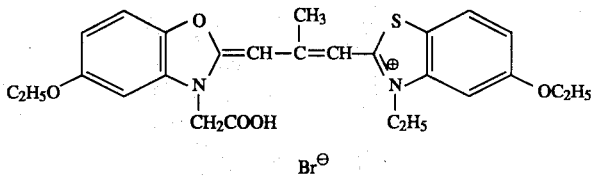
S-19
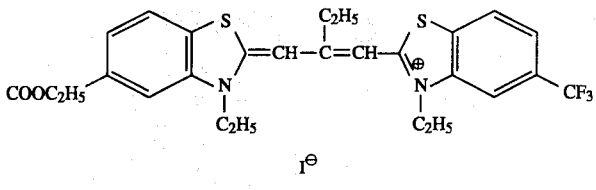
S-20
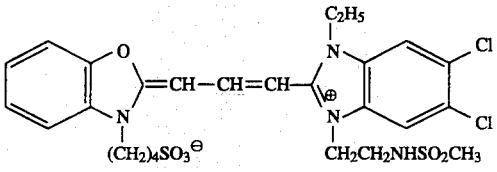
S-21
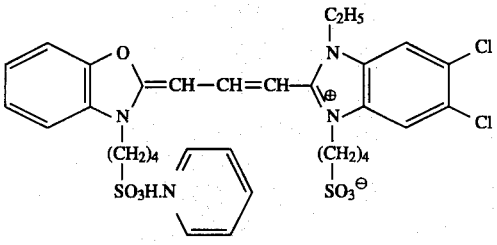
S-25
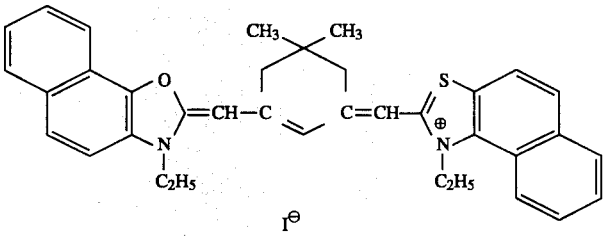

-continued

S-26

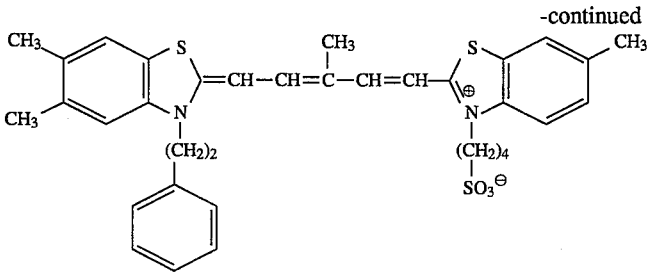

S-27

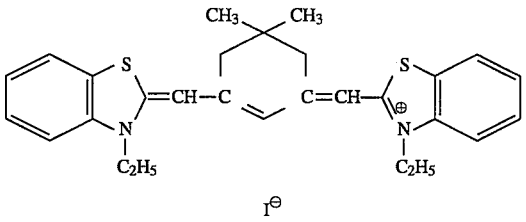

S-28

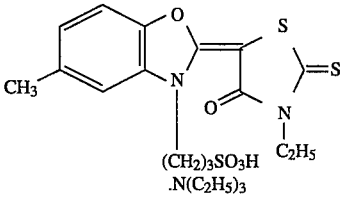

S-29

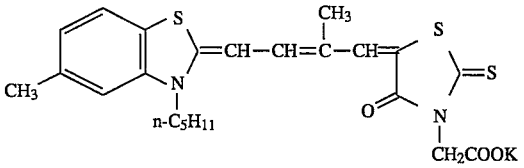

S-30

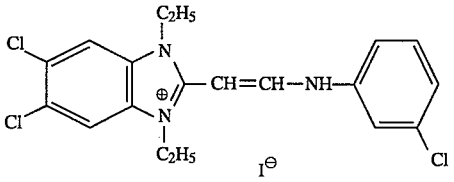

In the present invention, known spectral sensitizing dyes can be used, and these compounds can be easily synthesized by referring to methods described by F. M. Hamer in "Heterocyclic Compounds-Cyanine Dyes and Related Compounds", Chapter 5, pages 116 to 147 (John Wiley and Sons, 1964), by D. M. Sturmer in "Heterocyclic Compounds—Special Topics in Heterocyclic Chemistry", Chapter 8, Section 5, pages 482 to 515 (John Wiley and Sons, 1977), in Japanese Patent Publication Nos. 13823/1968, 16589/1969, 9966/1973, and 4936/1968, and in Japanese Patent Application (OPI) No. 82416/1977.

The silver halide emulsion that can be applied to the present invention comprises silver chloride or silver chlorobromide substantially free from silver iodide. The description of "substantially free from silver iodide" means that the content of silver iodide is 3 mol % or less, preferably 1 mol % or less, more preferably nil. Preferable halogen compositions are those having a silver chloride content of 30 mol % or over, more preferably 80 mol % or over, and most preferably 95 mol % or over. The silver halide grains contained in the emulsion may have the so-called layered-type structure that is made up of layers whose inner halogen composition is different from the surface halogen composition, or a multi-layer structure wherein portions whose halogen compositions are different are joined, or they may be ones wherein the halogen composition is present uniformly throughout the grains. These silver halide grains may be present as a mixture.

The average size of the silver halide grains for use in the present invention, expressed in terms of the average circle diameter having an area equal to the projected grain, is preferably 2.0 μm or less and larger than 0.1 μm, more preferably 1.0 μm or less and larger than 0.15 μm. Although the distribution of grain size is not restricted, a silver halide emulsion of excellent monodispersability is preferable. That is, the value obtained by dividing the standard deviation of statistics calculated from the curve of the size distribution by the average grain size (the deviation coefficient) is preferably 0.22 or less, more preferably 0.15 or less. In order to realize the gradation desired for the photographic material, two or more monodisperse silver halide emulsions (preferably having the above-mentioned deviation coefficient) different in grain size may be mixed in a single layer, or they may be coated as different layers having essentially the same color sensitivity.

The silver halide photographic emulsion for use in this invention may be a mixed emulsion each having the grain size distribution of 0.15 or less in terms of the deviation coefficient.

Although the silver halide grains for use in this invention may have any shape, grains which have a regular crystal structure, such as cubic, hexahedral, rohmbic dodecahedral, or tetradecahedral, are preferable. Silver grains may be used which form a latent image primary on the grain surface, or which form a latent image primary in the interior of the grains.

The photographic emulsion for use in this invention can be prepared by processes described in P. Glafkides, "Chimie et Physique Photographique" (Paul Montel, 1967), G. F. Duffin, "Photographic Emulsion Chemistry" (The Focal Press, 1966), V. L. Zelikman et al., "Making and Coating Photographic Emulsions" (The Focal Press, 1964), etc. Any one of an acidic process, a neutral process, and an ammoniacal process can be used. As a means of reacting a soluble silver salt with a soluble halide salt, any of the single jet method, double jet method, or a combination thereof may be employed.

A process of forming grains in the presence of excess silver ion (the so-called reversal mixing process) can be employed as well. As one type of double jet method, the "controlled double jet" process can be employed, wherein the pAg in the liquid phase of the silver halide formation is kept constant. This process provides a silver halide emulsion containing regular silver halide grains having an approximately monodisperse particle size.

During formation or physical ripening of the silver halide grains, cadmium salts, zinc salts, lead salts, thallium salts, iridium salts or complex salts thereof, rhodium salts or complex salts thereof, iron salts or complex salts thereof, etc., may also be present.

Precipitation, physical ripening, and chemical ripening can be carried out in the presence of conventional silver halide solvents (e.g., ammonia, potassium thiocyanate, thioethers, and thiones described in U.S. Pat. No. 3,271,157, Japanese Patent Application (OPI) Nos. 12360/1976, 82408/1978, 144319/1978, 100717/1979, and 155828/1979). Removing of the soluble salts from the emulsions after physical ripening can be achieved by noodle washing, flocculation precipitation, ultrafiltration, etc.

For the preparation of the silver halide emulsion used in the present invention, sulfur sensitization using active gelatin or sulfur-containing compounds capable of reacting with silver (e.g., thiosulfates, thioureas, mercapto compounds, rhodanines, etc.), reduction sensitization using a reductive substance (e.g., stannous salts, amines, hydrazine derivatives, formamidinesulfinic acid, silane compounds, etc.), and noble metal sensitization using noble metal compounds (e.g., complex salts of the Group VIII metals such as Pt, Ir, Pd, Rh, Fe, etc., as well as gold complex salts) can be employed alone or in combination.

In the preferred embodiment of the present invention, the photographic materials comprise a substrate having thereon at least one red-sensitive emulsion layer, at least one green-sensitive emulsion layer, and at least one blue-sensitive emulsion layer. The order of these layers may be optionally selected as the case demands. The preferable order of layers from the substrate side is red-sensitive, green-sensitive, and blue-sensitive, or green-sensitive, red-sensitive, and blue-sensitive. Each of the above-mentioned emulsion layers may consist of two or more layers which have different sensitivity, and a non-photosensitive layer may exist between two or more emulsion layers that have the same sensitivity. Usually, for the formation of a color image, the red-sensitive layer contains a non-diffusible cyan-forming coupler, the green-sensitive layer contains a non-diffusible magenta-forming coupler, and the blue-sensitive layer contains a non-diffusible yellow-forming coupler, but another combination may be employed if needed. Concerning the cyan, magenta, and yellow couplers to be used preferably in the present invention, compounds can be mentioned, for example, as are described on page 44 line 8 to page 81, especially the cyan couplers (C-1) to (C-46), the magenta couplers (M-1) to (M-20), and the yellow couplers (Y-1) to (Y-8) on pages 57 to 81, of Japanese Patent Application No. 39825/1987. More specifically, the following compounds can be mentioned.

Preferred examples of cyan coupler are shown below.

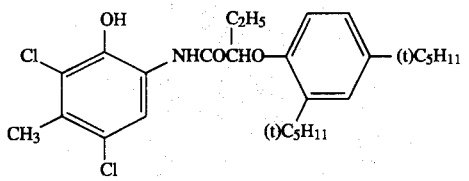

(C-1)

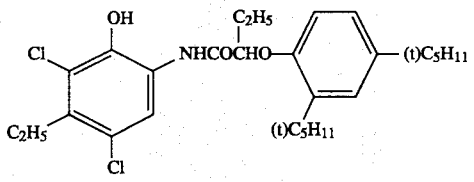

(C-2)

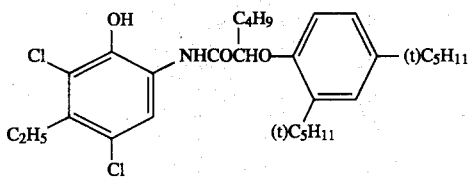

(C-3)

-continued
(C-4)
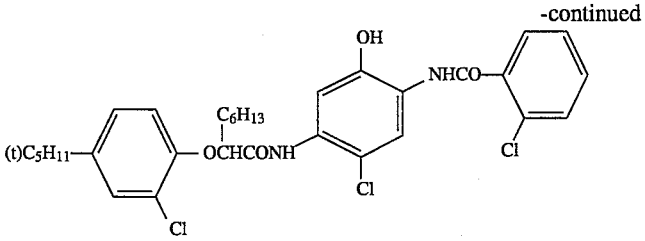
(C-5)
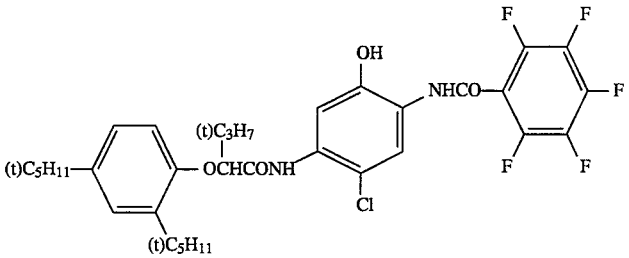
(C-6)
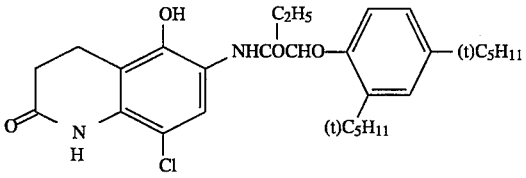
(C-7)
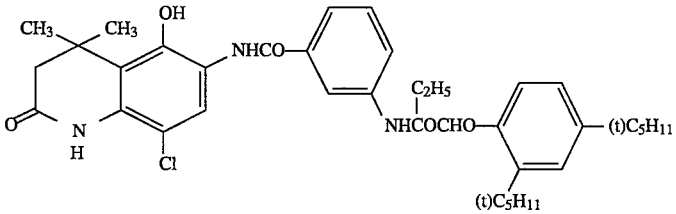
(C-8)
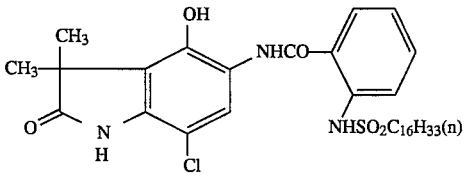
(C-9)
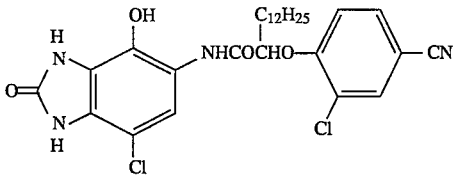
(C-10)
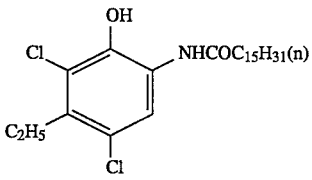
(C-11)
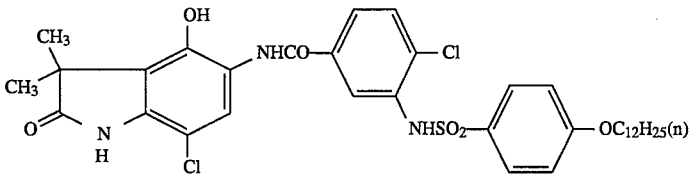
Preferred examples of magenta coupler are shown below.

(M-1)
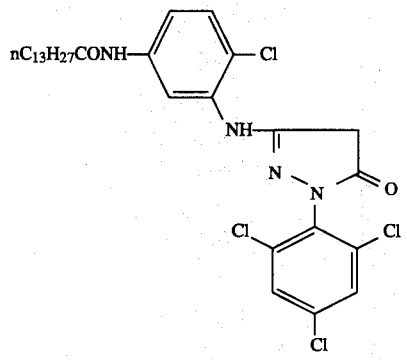
(M-2)
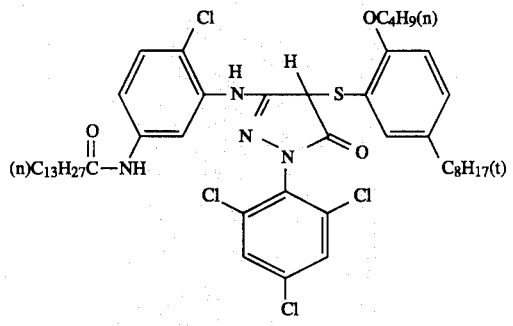
(M-3)
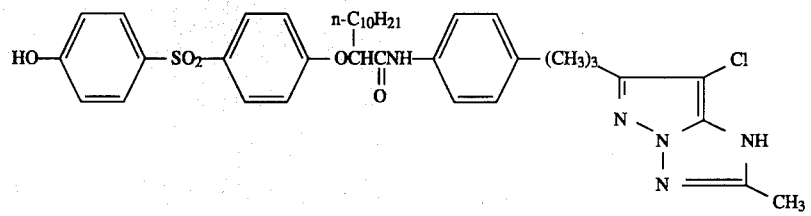
(M-4)
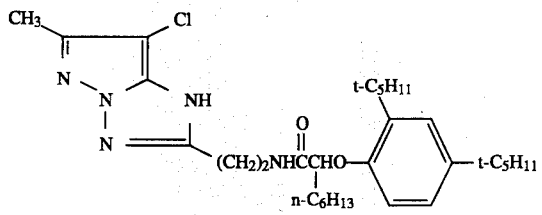
(M-5)
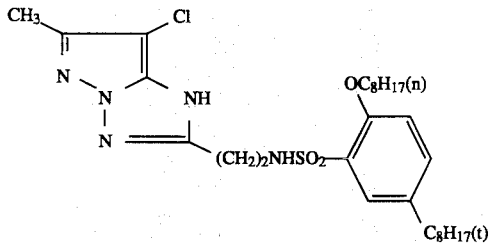

-continued
(M-6)
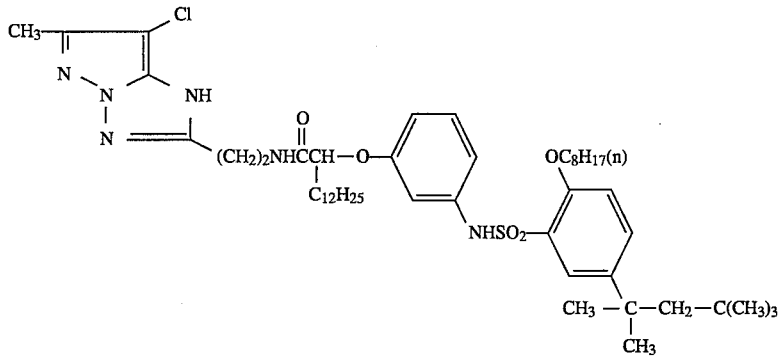
(M-7)
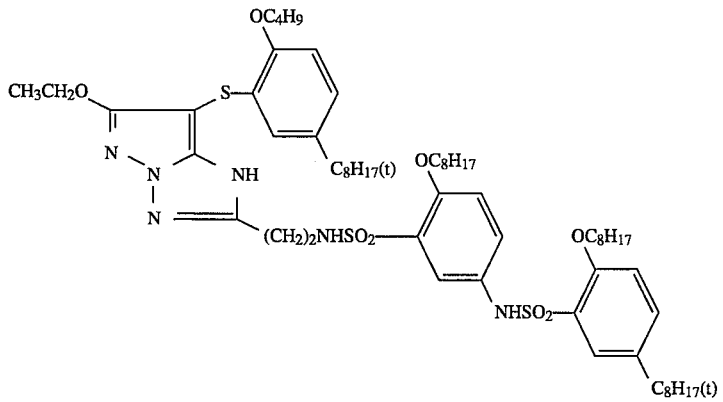
(M-8)
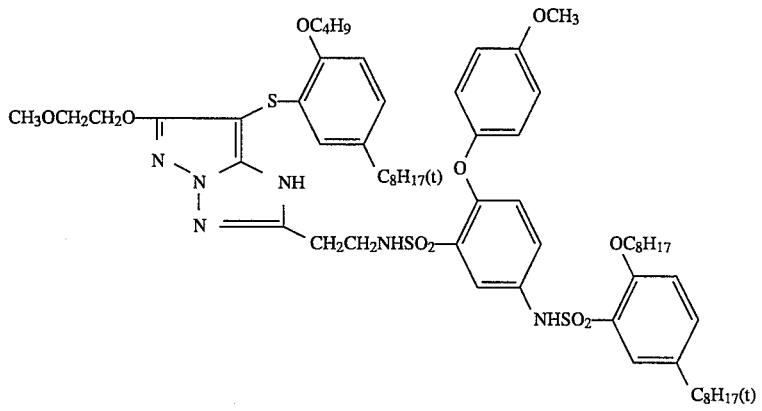
(M-9)
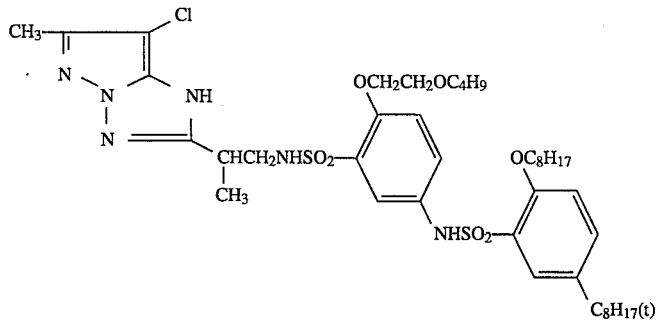

-continued
(M-10)
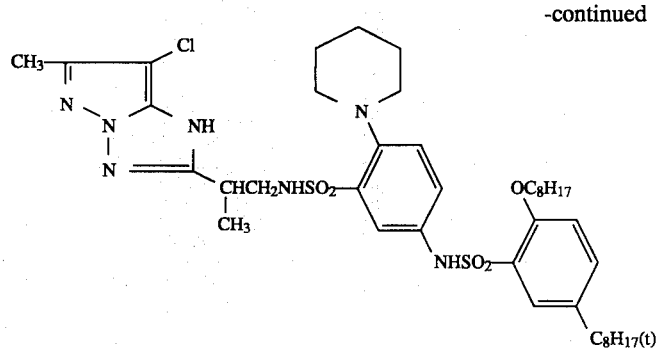
(M-11)
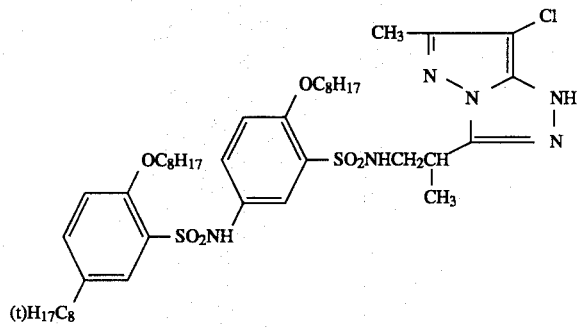
(M-12)
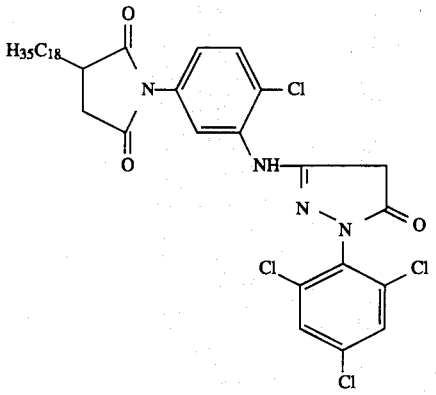
(M-13)
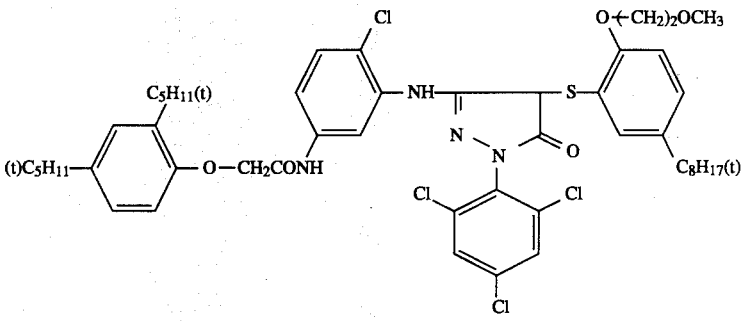

-continued
(M-14)
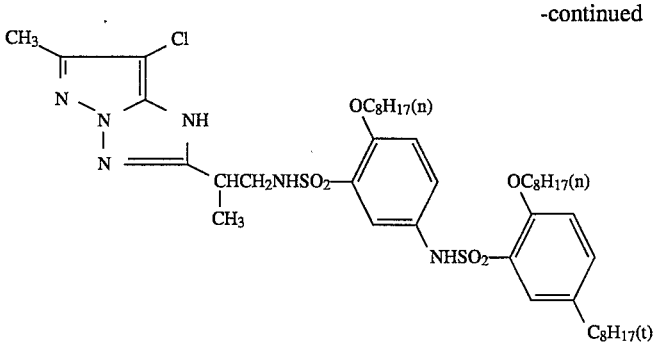
(M-15)
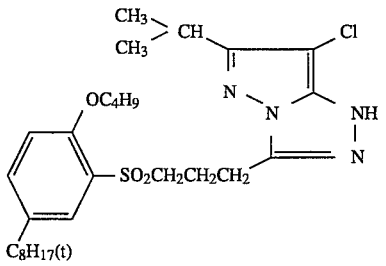
Preferred examples of yellow coupler are shown below.
(Y-1)
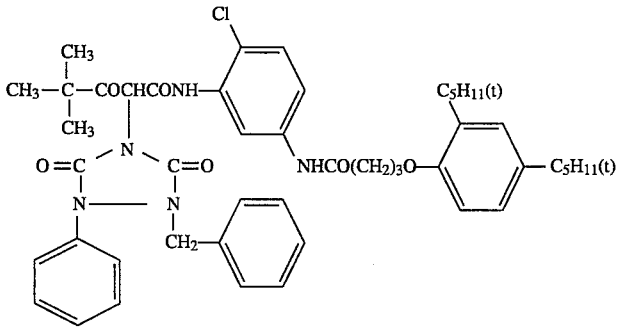
(Y-2)
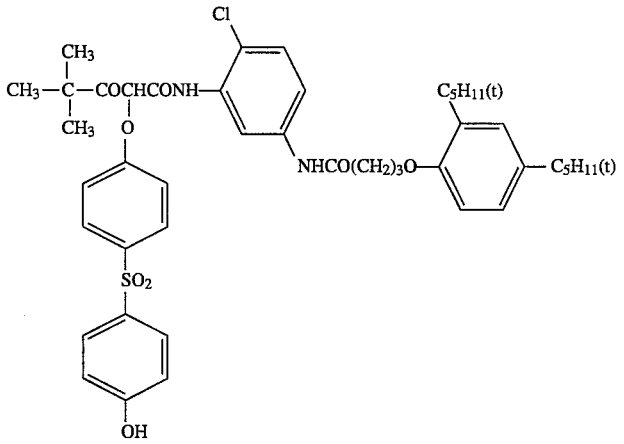

-continued
(Y-3)
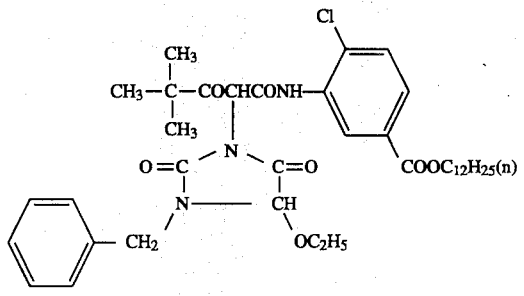
(Y-4)
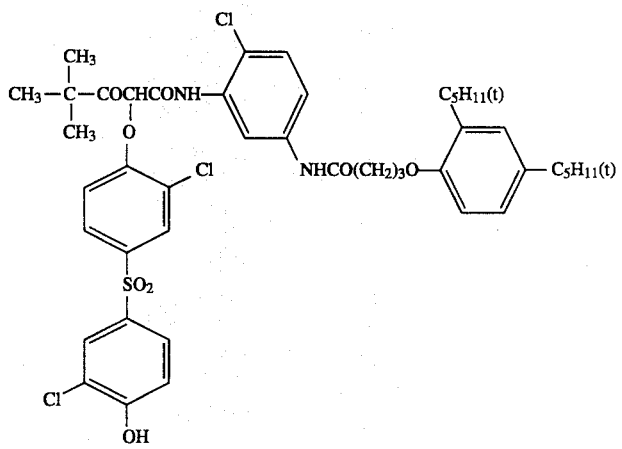
(Y-5)
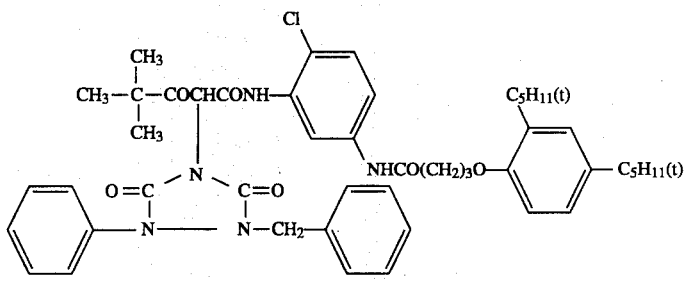
(Y-6)
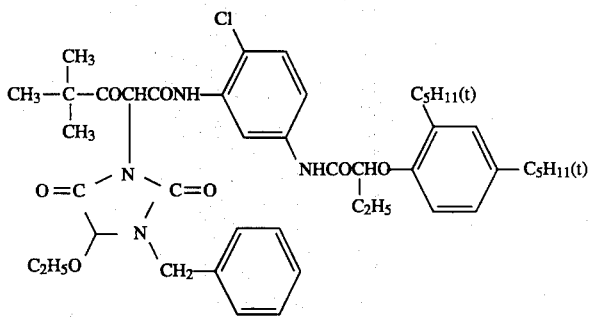
(Y-7)
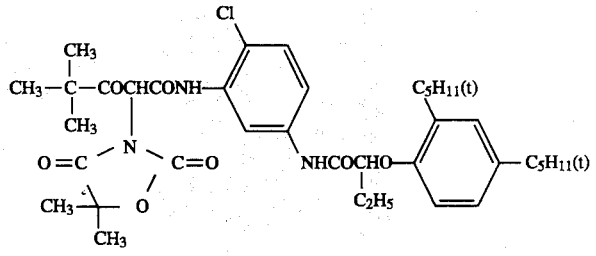

-continued (Y-8)

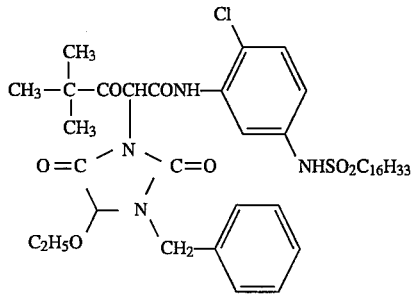

(Y-9)

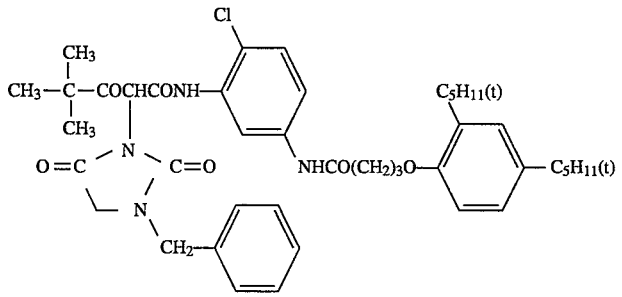

(Y-10)

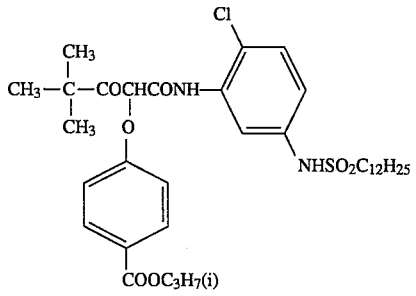

(Y-11)

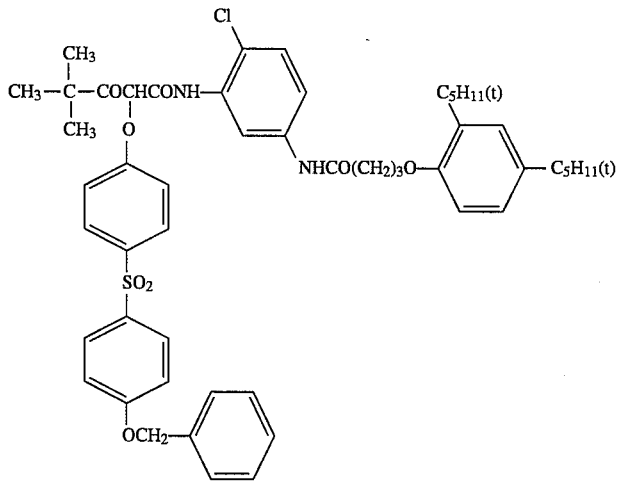

Together with the above couplers, monopolymers or copolymers described in the above-mentioned Japanese Patent Application No. 39825/1987, which consist of at least one type of repeating units having no acid group on the main chain or the side chain and which are insoluble in water and soluble in organic solvents, can also be used, and/or high-boiling organic solvents can be used independently. Detailed explanation and specific examples of high-boiling solvents are described in the above-mentioned Japanese Patent Application No. 39825/1987, pages 82 to 96.

To enhance the effect of improving dye stability and improving the color-forming property, it is preferable to additionally use compounds represented by general formulae (A) to (C), described in the above-mentioned Japanese Patent Application No. 39825/1987, pages 99 to 101, and more specifically compounds selected from compounds (X-1) to (X-19), described therein on pages 101 to 105.

The photographic material according to the present invention may have auxiliary layers, such as protective layers, intermediate layers, filter layers, antihalation layers, backing layers, etc., if necessary, in addition to the silver halide emulsion layers.

As a binder or protective colloid to be used in the present invention, it is beneficial to use gelatin, but a hydrophilic colloid other than gelatin can be used.

As a substrate for use in the present invention, a transparent base may be used, but the preferable substrate is a reflective base, such as, for example, baryta paper, polyethylene-coated paper, polypropylene synthetic paper, or a transparent base having a reflective layer or combined with a reflective material, such as, for example, glass plate, vinyl chloride resin, cellulose acetate, cellulose nitrate, film of polyesters such as polyethylene terephthalate, polyamide film, polycarbonate film, and polystyrene film. These substrates can be suitably selected according to the application.

For the development processing of the photographic material according to the present invention, a conventional black and white developing solution (such as described in "Shashinkagaku" by Shinichi Kikuchi, Chapter 7 to Chapter 11 of Kyoritsu-shisho), and a developing solution for use in a color-forming method, diffusion transfer method and silver-dye bleaching method (Chapter 11 to Chapter 16 of "The Theory of Photographic Process" by T. H. James, 4th Edition) can be used.

The color-developing solution suitable for use in the present invention will be described below in detail.

With respect to color developing solutions used in development processing of the photographic materials of the present invention, reference will be made to Japanese Patent Application No. 253716/1986, page 71, line 4 to page 72, line 9.

The color-developing solution used in the present invention contains an ordinary aromatic primary amine color-developing agent. Preferred examples of aromatic primary amine color-developing agents are p-phenylenediamine derivatives. Representative examples are given below, but they are not meant to limit the present invention:

D-1: N,N-diethyl-p-phenylenediamine

D-2: 2-amino-5-diethylaminotoluene

D-3: 2-amino-5-(N-ethyl-N-laurylamino)toluene

D-4: 4-[N-ethyl-N-(β-hydroxylethyl)amino]aniline

D-5: 2-methyl-4-[N-ethyl-N-(β-hydroxyethyl)amino] aniline

D-6: 4-amino-3-methyl-N-ethyl-N-[β-(methanesulfonamido)ethyl] -aniline

D-7: N-(2-amino-5-diethylaminophenylethyl-)methanesulfonamide

D-8: N,N-dimethyl-p-phenylenediamine

D-9: 4-amino-3-methyl-N-ethyl-N-methoxyethylaniline

D-10: 4-amino-3-methyl-N-ethyl-N-β-ethoxyethylaniline

D-11: 4-amino-3-methyl-N-ethyl-N-β-butoxyethylaniline

Of the above-mentioned p-phenylenediamine derivatives, 4-amino-3-methyl-N-ethyl-N-[β-(methanesulfonamido)ethyl] -aniline (exemplified compound D-6) is particularly preferable.

These p-phenylenediamine derivatives may be in the form of salts such as sulfates, hydrochlorides, sulfites, and p-toluenesulfonates. The amount of aromatic primary amine developing agent to be used is about 0.1 g to about 20 g, preferably about 0.5 g to about 10 g, per liter of developer.

Generally, the pH of the developing solution of the present invention is 9.0 to 12.5, preferably 9.0 to 12.0, and more preferably 9.8 to 11.5. Details of additives such as preservative, buffer, chelating agent, development accelerater, anti-fogging agent and brightening agent and the amount of them to be added to the color developing solution are described in Japanese Patent Application (OPI) No. 63526/1987. Further, it is preferable that the color-developing solution of the present invention is substantially free from benzyl alcohol.

The processing temperature using the color-developing solution is between 20° to 50° C., preferably 30° to 40° C. The processing time is between 20 sec. to 5 min., preferably 30 sec. to 2 min. It is preferable to use a smaller amount of replenisher, generally 20 to 600 ml, preferably 50 to 300 ml, and more preferably 100 to 200 ml, per $m^2$ of the photographic material.

Generally, the photographic emulsion layer, after color development, is subjected to bleaching processing. Bleaching processing may be effected together with fixing processing as a one-bath bleach-fixing, or it may be effected separately from the fixing processing. Further, to quicken the processing, bleach-fixing processing may be effected after bleaching processing or fixing processing. Generally, the bleaching solution or the bleach-fixing solution of the present invention may use, as a bleaching agent, an aminopolycarboxylic acid iron complex salt. As additives to be used in the bleaching solution or the bleach-fix solution, use can be made of various compounds described in Japanese Patent Application (OPI) No. 215272/1987 (from the right lower column of page 6 to the right lower column of page 8). After the desilvering step (bleach-fixing or fixing), processing such as washing and/or stabilizing is effected. As the washing water or stabilizing solution, use can be made of water that has been softened. For softening water can be mentioned a method that uses a reverse osmosis apparatus or ion exchange resins described in Japanese Patent Application (OPI) No. 28838/1987. As a specified method of these, it is preferable to use a method described in Japanese Patent Application (OPI) No. 28838/1987.

Further, as additives used in washing and stabilizing steps, use can be made of various compounds described in Japanese Patent Application (OPI) No. 215272/1987 (from the right lower column of page 8 to the right upper column of page 10).

In each processing step, the smaller the amount of the replenishing solution, the more preferable. Preferably the amount of the replenishing solution is 0.1 to 50 times, more preferably 3 to 30 times, the amount of the carried-over from the previous bath per unit area of the photographic material.

The photographic materials of the present invention are not only useful for photographic paper, particularly color photographic paper, but they also can be used for all types of other silver halide photographic materials.

For example, the photographic material of the present invention can be used for black and white and color photographic materials for photographing, photographic materials for a color diffusion transfer process, photographic materials for a silver salt diffusion transfer process, heat development type photographic materials, color reversal paper, color reversal film for photographing, and black and white and color direct positive photographic materials.

The preferable coating amount of the compounds represented by formula (I), (II), and (III) for use in the present invention is in the range of $1\times10^{-6}$ to $2\times 10^{-4}$ mol/$m^2$, although it is not restricted to the above range. These compounds represented by the formula (I), (II), and (III) may be added to an arbitrary hydrophilic layer on the substrate, for example, a silver halide emulsion layer, an intermediate layer, or a protective layer.

Examples of the compound represented by formula (I), (II), and (III) are shown below, but the invention is not limited to them.

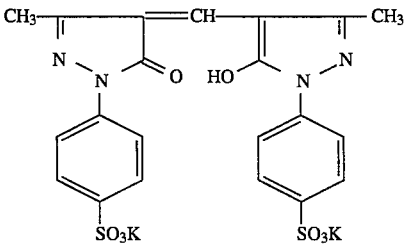
F-I-1
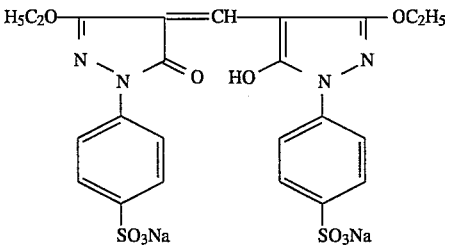
F-I-2
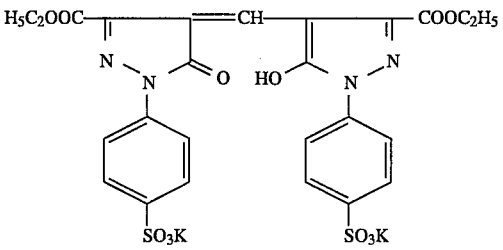
F-I-3
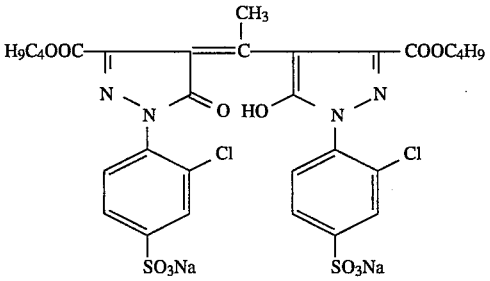
F-I-4
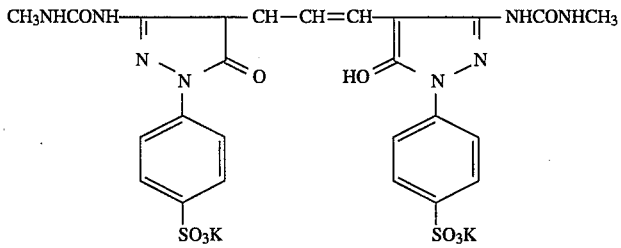
F-I-5
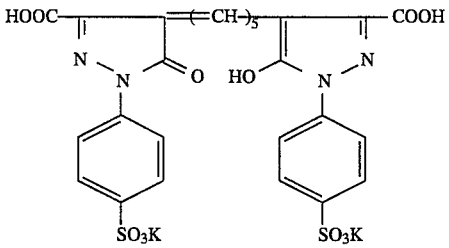
F-I-6
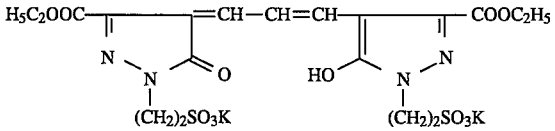
F-I-7

-continued
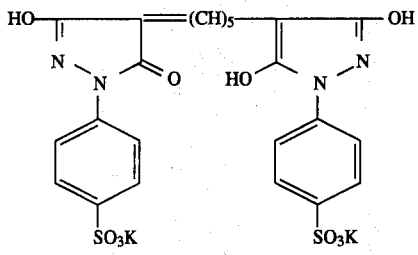
F-I-8
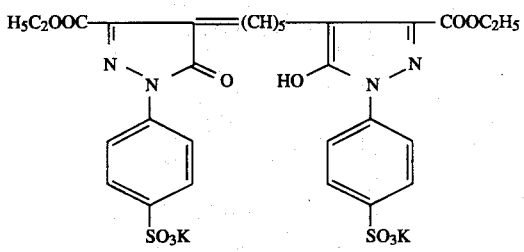
F-I-9
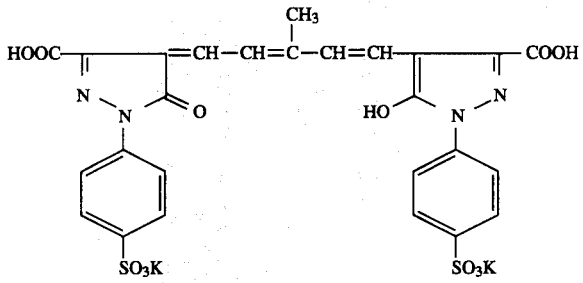
F-I-10
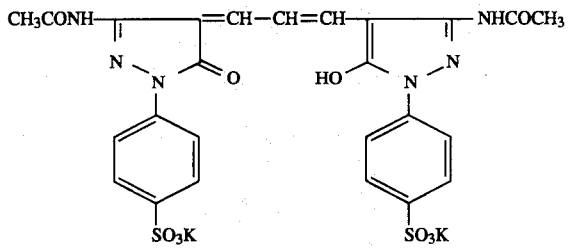
F-I-11
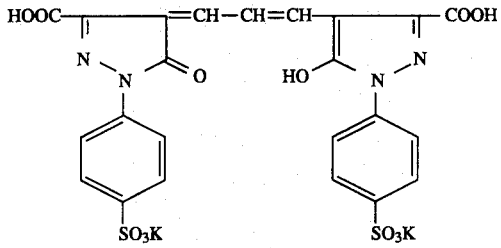
F-I-12
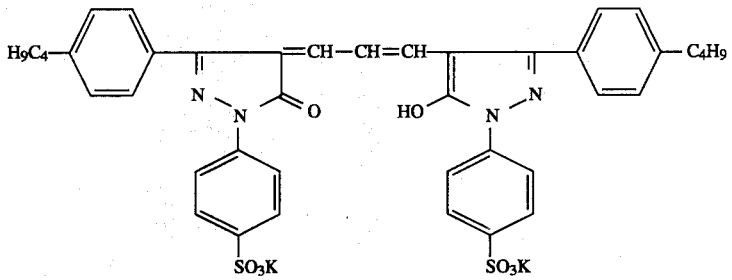
F-I-13

-continued
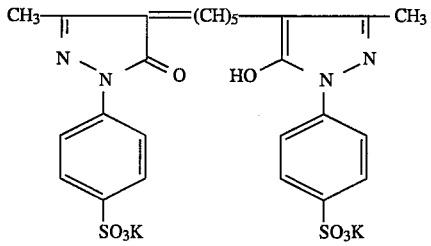
F-I-14
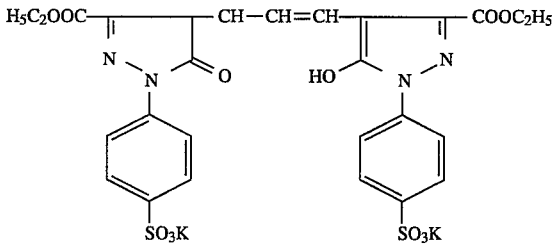
F-I-14
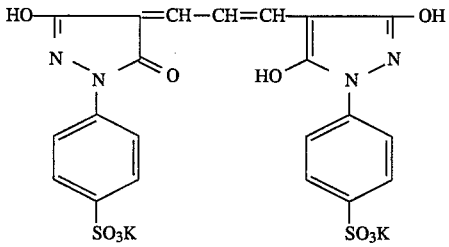
F-I-16
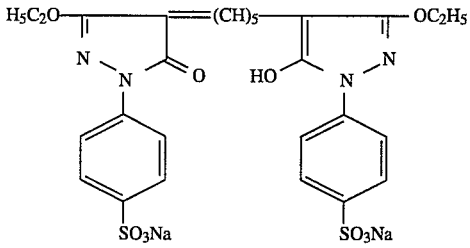
F-I-17
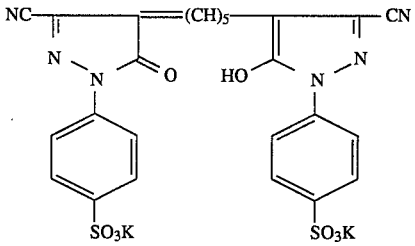
F-I-18
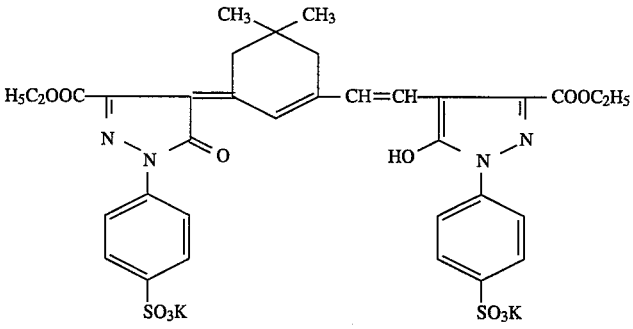
F-I-19

-continued
F-I-20
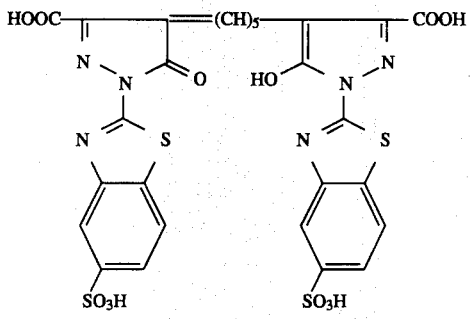
F-I-21
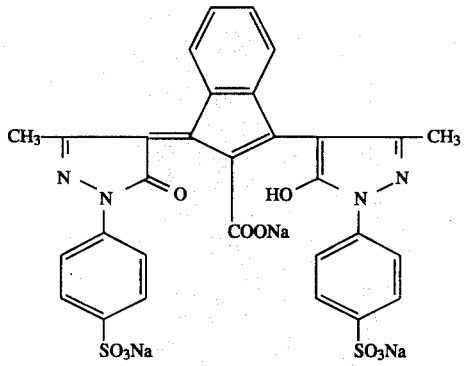
F-I-22
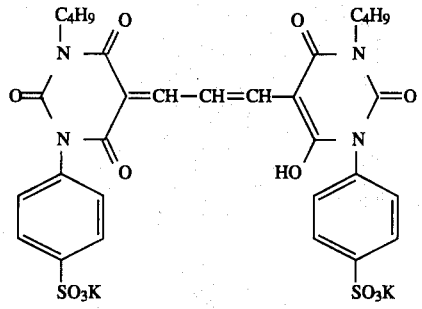
F-I-23
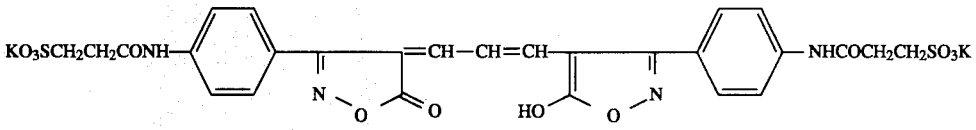
F-I-24
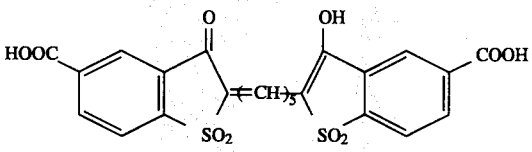
F-I-25
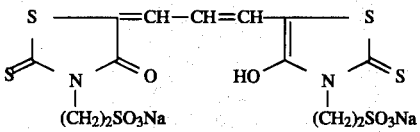
F-I-26
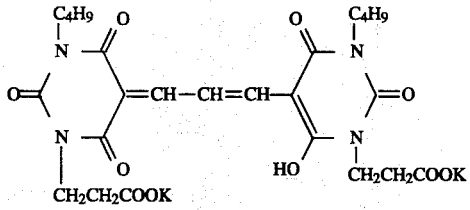

-continued
F-I-27
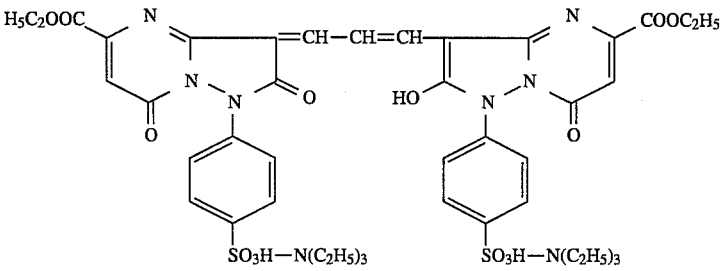
F-I-28
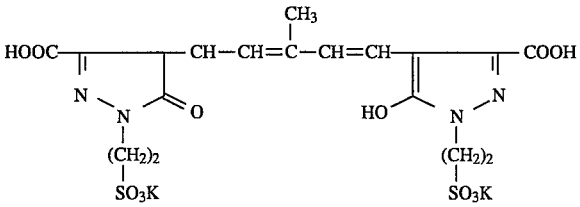
F-I-29
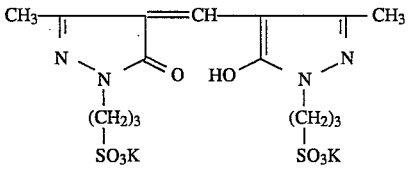
F-I-30
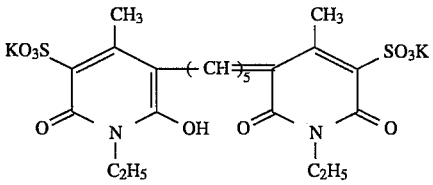
F-I-31
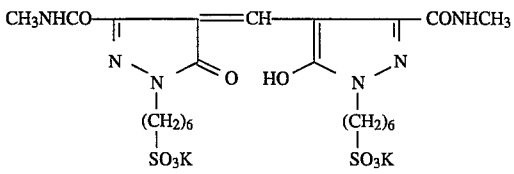
F-I-32
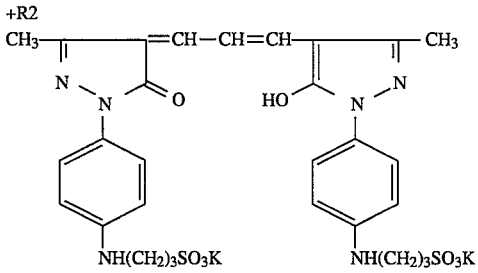
F-I-33
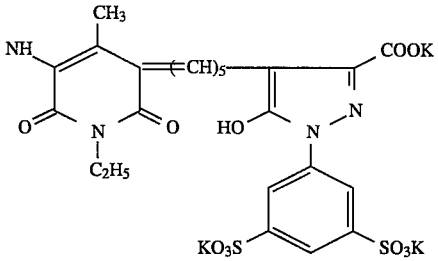

-continued
F-I-34
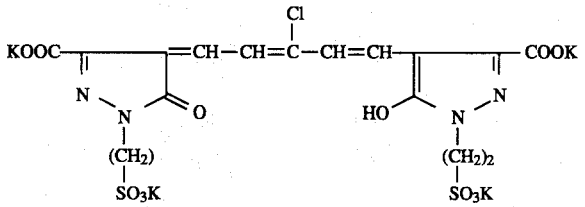
F-I-35
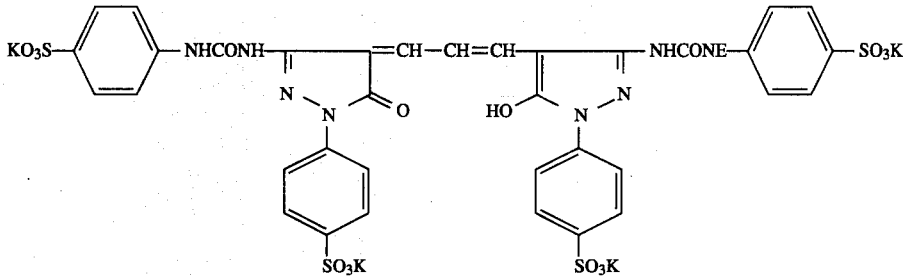
F-I-36
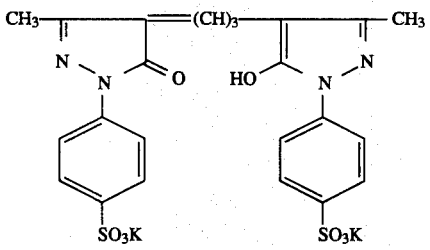
F-I-37
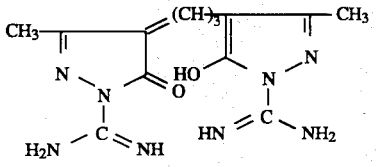
F-I-38
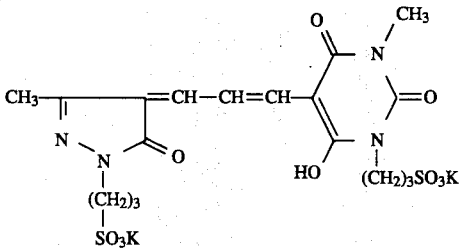
F-I-39
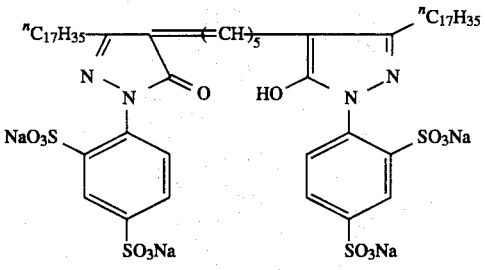

-continued
F-I-40
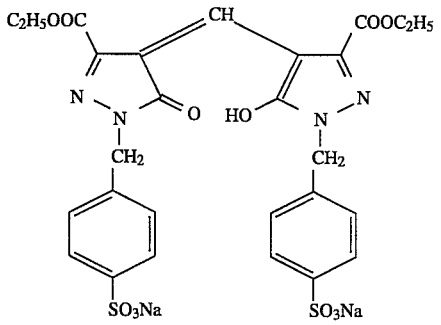
F-I-41
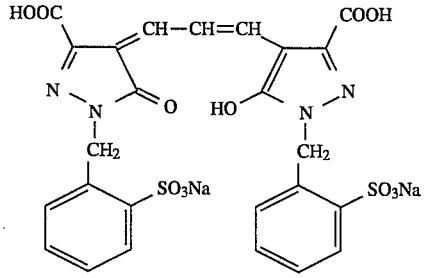
F-I-42
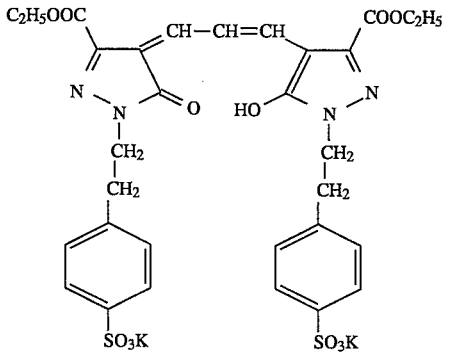
F-I-43
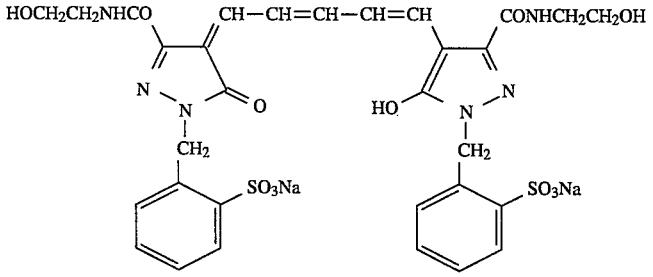
F-II-1
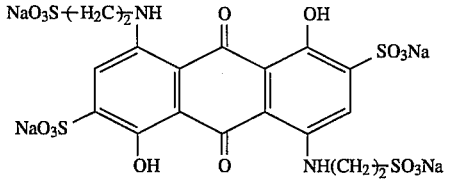
F-II-2
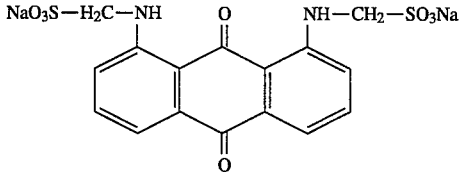

-continued
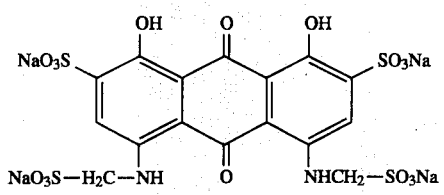
F-II-3
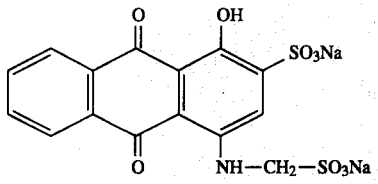
F-II-4
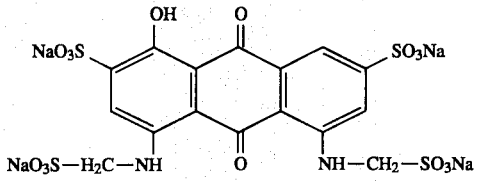
F-II-5
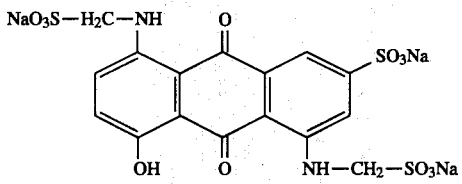
F-II-6
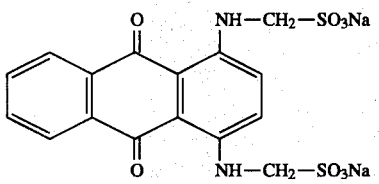
F-II-7
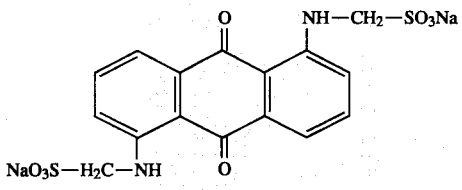
F-II-8
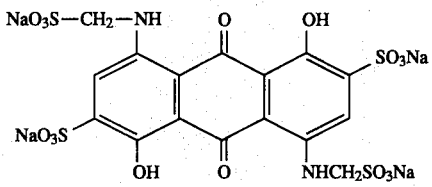
F-II-9
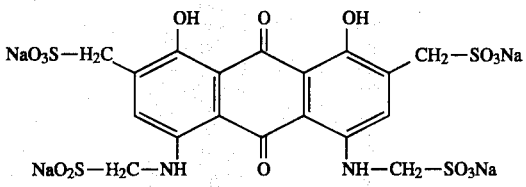
F-II-10
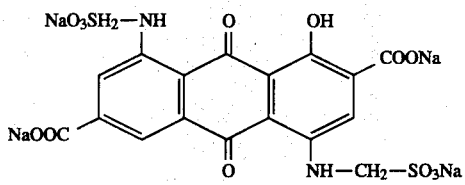
F-II-11

-continued
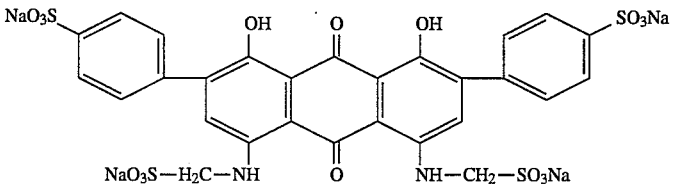
F-II-12
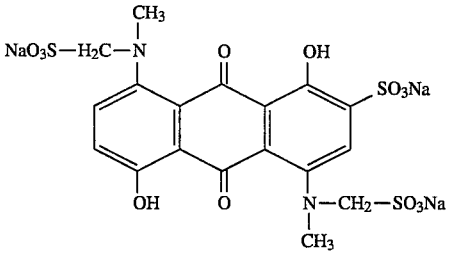
F-II-13
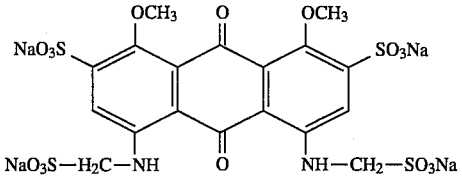
F-II-14
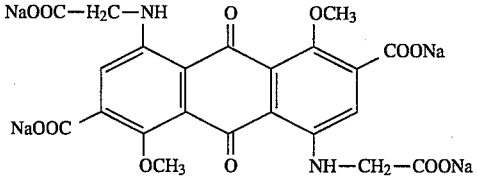
F-II-15
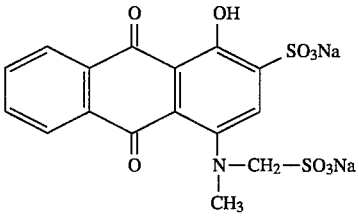
F-II-16
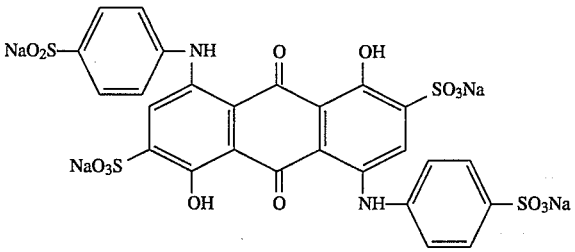
F-II-17
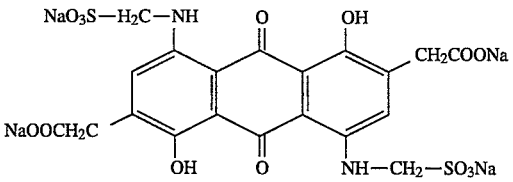
F-II-18

-continued
F-II-19
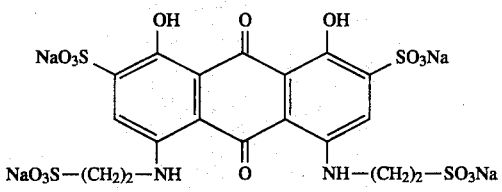
F-II-20
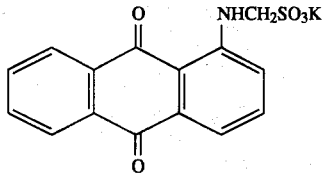
F-11-21
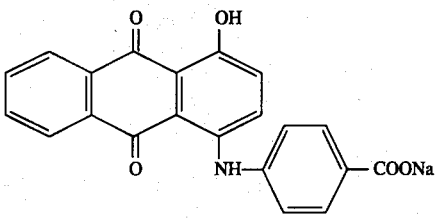
F-11-22
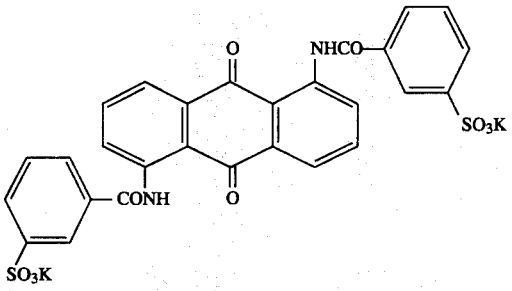
F-II-23
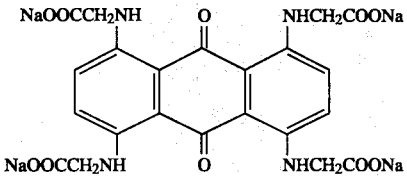
F-III-1
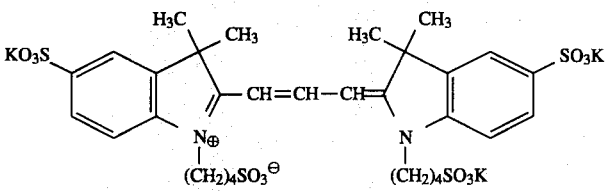
F-III-2
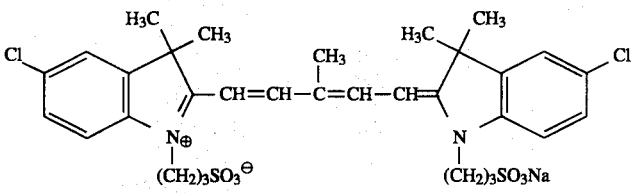
F-III-3
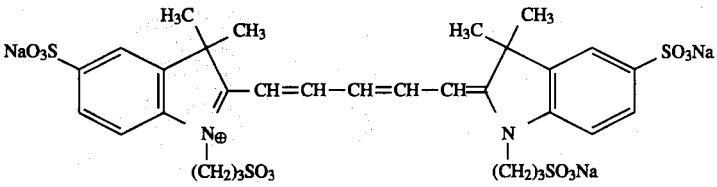

-continued
F-III-4
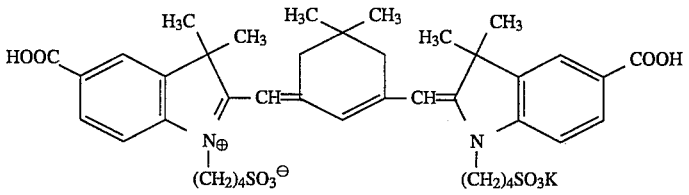
F-III-5
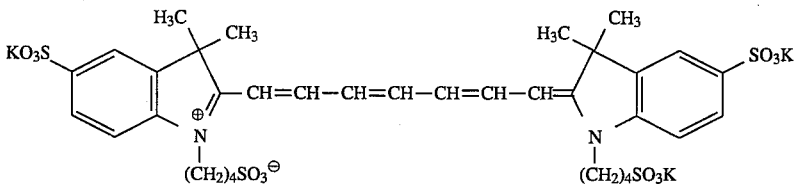
F-III-6
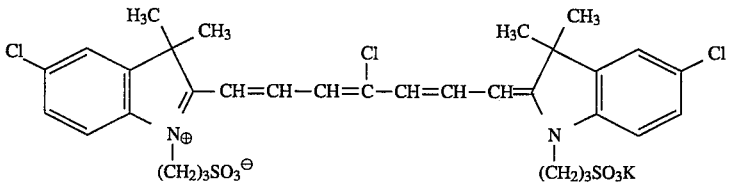
F-III-7
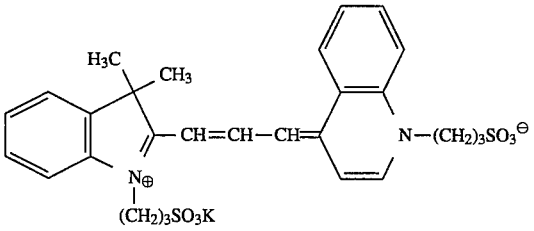
F-III-8
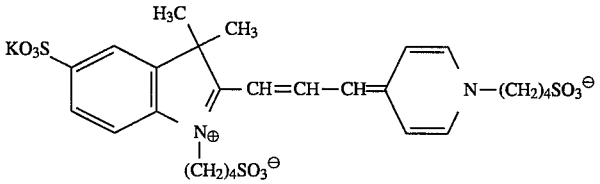
F-III-9
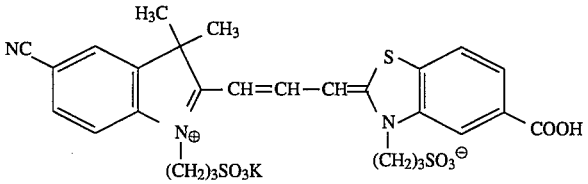
F-III-10
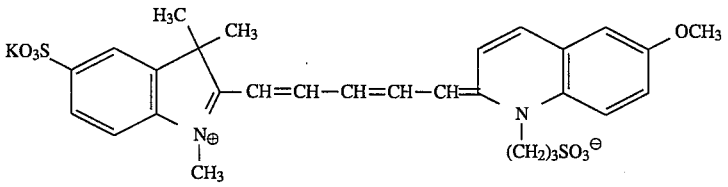
F-III-11
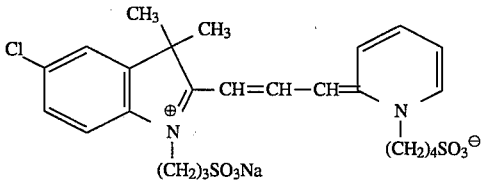

-continued
F-III-12
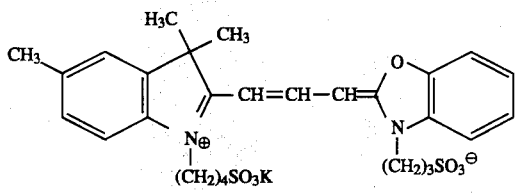
F-III-13
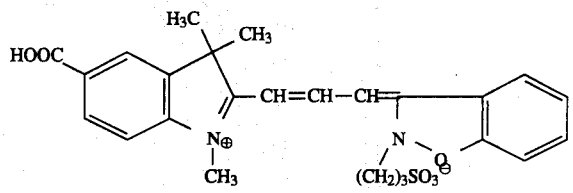
F-III-14
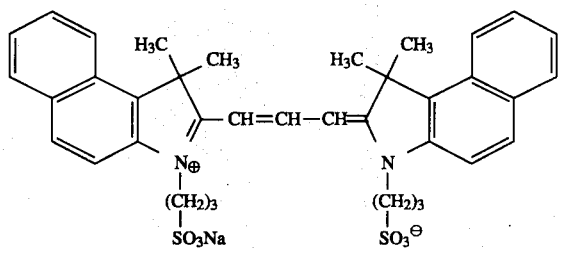
F-III-15
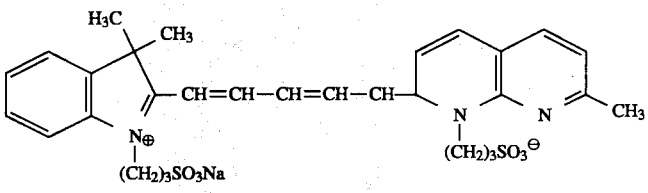
F-III-16
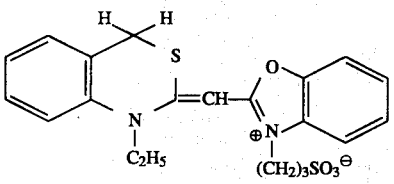
F-III-17
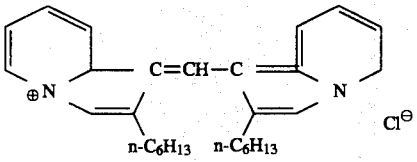
F-III-18
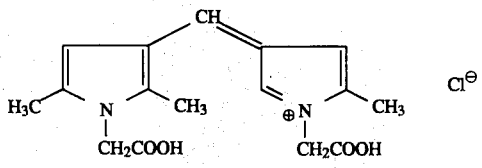
F-III-19
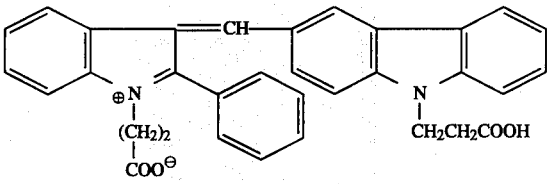

-continued
F-III-20
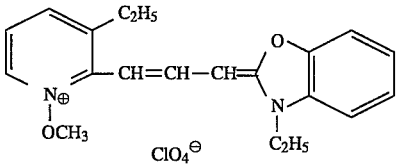
F-III-21
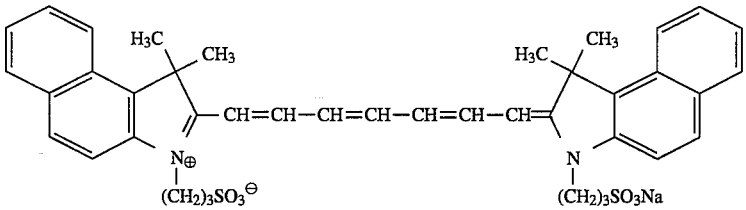
F-III-22
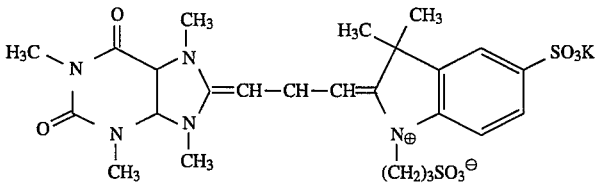
F-III-23
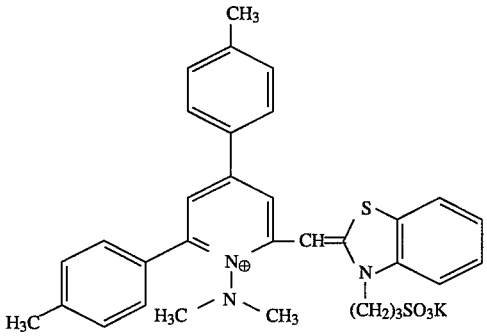
F-III-24
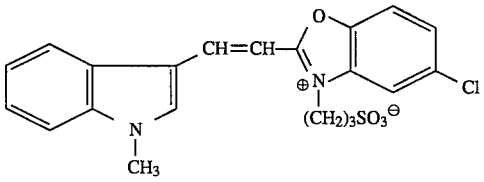
F-III-25
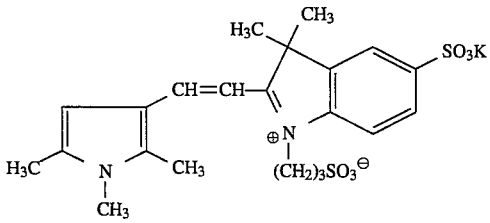
F-III-26
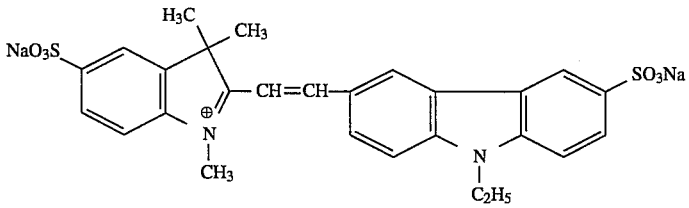

-continued

F-III-27

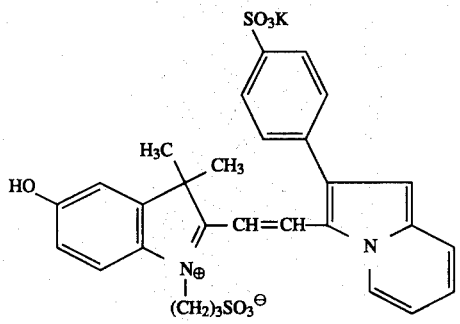

F-III-28

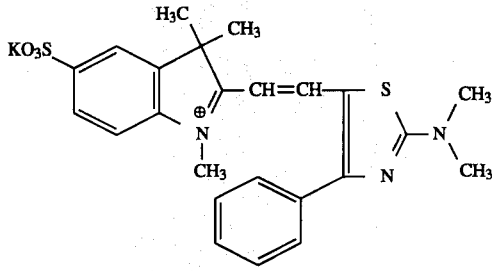

F-III-29

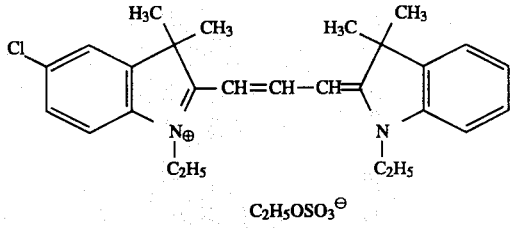

The photographic materials of the present invention are suitable for rapid processing, low in fogging, and high in sensitivity, and gradation.

The silver halide photographic materials of the present invention are not only high in sensitivity and gradation but also excellent in sharpness, and exhibit such an excellent effect that the change in sensitivity due to change of humidity when exposed is less.

Further, the silver halide photographic materials of the present invention can be subjected to rapid processing, and are excellent in color reproduction of color images.

The invention will now be described with reference to Examples.

EXAMPLE 1

Silver halide emulsion (1) used in this example according to the invention was prepared as follows.

| | |
|---|---|
| (First solution) | |
| $H_2O$ | 850 ml |
| NaCl | 3.3 g |
| Gelatin | 32 g |
| (Second solution) | |
| Sulfuric acid (1 N) | 24 ml |
| (Third solution) | |
| Silver halide solvent shown below (1%) | 3 ml |

-continued

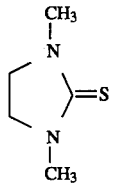

| | |
|---|---|
| (Fourth solution) | |
| NaCl | 11.0 g |
| $H_2O$ to make | 200 ml |
| (Fifth solution) | |
| $AgNO_3$ | 32 g |
| $H_2O$ to make | 200 ml |
| (Sixth solution) | |
| NaCl | 44.0 g |
| $K_2IrCl_6$ (0.001%) | 4.54 ml |
| $H_2O$ to make | 600 ml |
| (Seventh solution) | |
| $AgNO_3$ | 128 g |
| $H_2O$ to make | 600 ml |

The first solution was heated to 60° C., and the second and third solutions were added thereto. Thereafter, the fourth and fifth solutions were simultaneously added thereto over 8 minutes. After a further 8 minutes had passed, the sixth and seventh solutions were simultaneously added thereto over 10 minutes. Five minutes later the temperature was lowered and desalting was effected. Then water and dispersed gelatin were added and the pH was adjusted to 6.2, thereby giving a monodisperse cube pure silver chloride emulsion having an average grain size of 0.45 μm and a deviation coefficient (a value obtained by dividing the standard deviation by the average grain size: s/d ) of 0.08.

In the preparation of Emulsion (1), 5 minutes before completion of the addition of the sixth and seventh solutions, a green-sensitive sensitizing dye, (a) shown below, was added in an amount of $4.0\times10^{-4}$ mol per mol of the silver halide, to prepare Emulsion (2).

(a) Green-sensitizing dye

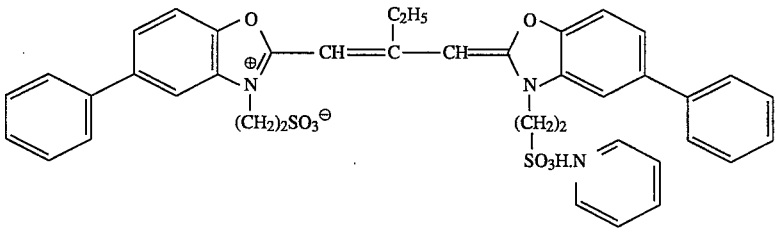

Further, 1 minute before completion of the addition of the sixth and seventh solutions, by adding the green-sensitizing dye (a), Emulsion (3) was prepared.

In the preparation of Emulsion (1), immediately after completion of the addition of the sixth and seventh solutions, the green-sensitizing dye (a) was added, and then desalting was effected to prepare Emulsion (4).

Emulsions (1) to (4) were optimally sensitized chemically by adding sodium thiosulfate. In the preparation of Emulsion (1), after the desalting and before the addition of sodium thiosulfate, green-sensitizing dye (a) was added, thereby preparing Emulsion (5). Emulsion (5) was also optimally sensitized chemically by adding sodium thiosulfate. The grain sizes and the deviation coefficient of the thus-obtained Emulsions (1) to (5) are shown in Table 1.

TABLE 1

| Emulsion | Grain size (edge length) (μm) | Deviation coefficient |
|---|---|---|
| 1 | 0.45 | 0.08 |
| 2 | 0.44 | 0.23 |
| 3 | 0.45 | 0.08 |
| 4 | 0.45 | 0.08 |
| 5 | 0.44 | 0.07 |

Then, 13.6 ml of ethyl acetate and 10.0 ml of solvent (d) were added to 10.0 g of magenta coupler (b) and 4.1 g of color-image stabilizer (c) to dissolve them, and the solution was emulsified and dispersed into 150 ml a 10% aqueous gelatin solution containing 8 ml of 10% of sodium dodecylbenzenesulfonate. t,1110

The green-sensitizing dye (a) shown above was added to the previously-prepared Emulsion (1) in an amount of $4.0\times10^{-4}$ mol per mol of the silver halide, thereby preparing a green-sensitive emulsion, and the green-sensitive emulsion and Emulsions (2) to (5) were combined with the emulsified dispersion obtained above to prepare coating liquids, and the coating liquids were applied together with a protective layer of gelatin onto a two-side polyethylene-laminated paper base, thereby preparing Samples 1 to 5. The construction of the samples are shown in Table 2.

Samples 1 to 5 were subjected to gradation exposure for 0.5 sec for sensitometry through a green filter using a sensitometer (FWH model, manufactured by Fuji Photo Film Co., Ltd.; color temperature of the light source: 3200 K).

To measure the inherent sensitivity, exposure was made through, instead of a green filter, a glass filter, UVD- 33S, manufactured by Toshiba.

Thereafter, processing was performed using a color-developing solution, (A), shown below.

TABLE 2

| Layer | Major ingredient | Amount used |
|---|---|---|
| First layer (protective layer) | Gelatin | 1.33 g/m² |
| | Acryl-modified copolymer of polyvinyl alcohol (degree of modification: 17%) | 0.17 g/m² |
| | Liquid paraffin | 0.03 g/m² |
| Second layer (green-sensitive emulsion layer) | Silver halide emulsion; silver: | 0.36 g/m² |
| | Gelatin | 1.24 g/m² |
| | Magenta coupler (b) | 0.31 g/m² |
| | Image-dye stabilizer (c) | 0.25 g/m² |
| | Solvent (d) | 0.42 g/m² |
| Base | Polyethylene-laminated paper (the polyethylene containing, on the first layer side, white pigment ($TiO_2$) and bluish dye (ultramarine)) | |

The processing included color development, bleach-fixing, and rinsing; the color development was effected at 35° C. for 45 sec, the bleach-fixing was effected at 35° C. for 45 sec, and the rinsing was effected at 35° C. for 90 sec.

The formulation of each of the processing solutions is shown below:

| Color-developing solution-A | |
|---|---|
| Water | 800 ml |
| Tetrasodium diethylenetriaminetetraacetate | 1.0 g |
| Sodium sulfite | 0.2 g |
| N,N-diethylhydroxyamine | 4.2 g |
| Potassium bromide | 0.01 g |
| Sodium chloride | 1.5 g |
| Triethanolamine | 8.0 g |
| N-ethyl-N-(β-methanesulfonamidoethyl)-3-methyl-4-aminoaniline sulfate | 4.5 g |
| Potassium carbonate | 30.0 g |
| 4,4'-diaminostilbene-type brightening agent (Whitex 4, manufactured by Sumitomo Chemical Co., Ltd.) | 2.0 g |
| Water to make | 1000 ml |
| pH | 10.1 |
| **Bleach-fixing solution-A** | |
| Water | 700 ml |

-continued

| | |
|---|---|
| Ammonium thiosulfate (54 wt. %) | 150 ml |
| Sodium sulfite | 15 g |
| $NH_4$[Fe(III) (EDTA)] | 55 g |
| EDTA.2Na (dihydrate) | 4 g |
| Glacial acetic acid | 8.61 g |
| Water to make | 1000 ml |
| pH | 5.4 |
| Rinsing solution | |
| EDTA.2Na (dihydrate) | 0.4 g |
| Water to | 1000 ml |
| pH | 7.0 |

The results of the photographic performance of Samples 1 to 5 are shown in Table 3.

TABLE 3

| Sample | Relative sensitivity[1)] Green sensitivity | Inherent sensitivity | Fogging | γ[2)] |
|---|---|---|---|---|
| 1 (comparative example) | 100 | 100 | 0.10 | 1.46 |
| 2 (comparative example) | 251 | 178 | 0.11 | 0.98 |
| 3 (this invention) | 321 | 252 | 0.09 | 1.73 |
| 4 (this invention) | 293 | 220 | 0.10 | 1.62 |
| 5 (comparative example) | 170 | 140 | 0.11 | 1.43 |

[1)]The reciprocal of the amount of light exposure that gives a fogging density of +0.5, given as a relative value with the value of Sample 1 assumed as 100.

[2)]Gradation γ is given by the density difference between the above sensitivity point and the point where 0.5 is increased in terms of log E of the amount of light exposure.

In Emulsion (1), the amount of sodium thiosulfate added was increased further, followed by chemical sensitization, thereby preparing Emulsion (5').

Before the application, dye (a) was added to Emulsion (5') in an amount of $4.0\times10^{-4}$ mol per mol of the silver halide, and it was combined with the above magenta coupler-emulsified dispersion to prepare Sample 5' in the same manner as Samples 1 to 5.

The results of the photographic performance of Sample 5' are shown in Table 4. The relative sensitivity is given by assuming the sensitivity of Sample 1 in Table 3 as 100.

TABLE 4

| Sample | Relative sensitivity Green sensitivity | Inherent sensitivity | Fogging | γ |
|---|---|---|---|---|
| 5' (comparative example) | 220 | 218 | 0.35 | 1.44 |

As is apparent from Table 3, samples that used the emulsions of the present invention showed high contrast, low fogging, and very high sensitivity. Although Sample 2, which used an emulsion wherein the addition of the spectral-sensitizing dye was effected in the earlier stage showed high sensitivity, it was not suitable for practical use because of soft gradation. Sample 5, which used an emulsion wherein after the desalting step and before chemical ripening a spectral sensitizing dye was added, did not give enough sensitivity. By comparing Table 3 and Table 4, it is apparent that Sample 5', which was prepared by the usual dye-adding method (that is, the dye was added after completion of the chemical ripening), could give a high level of sensitivity by intensifying the chemical sensitization, but when compared with the samples prepared according to the present invention, fogging, for Sample 5', became high.

EXAMPLE 2

Example 1 was repeated to prepare emulsions, except that in the first, fourth, and sixth solutions, the amounts of NaCl were reduced and KBr was added in suitable amounts. In addition to make the grain size uniform, the temperature, the period over which the addition was effected, and the amount of the silver halide solvent in the third solution were adjusted. Sodium thiosulfate was added to these emulsions in such amounts that fogging of the emulsions did not increase excessively; thereby the emulsions were optimally sensitized chemically. The obtained emulsions were monodisperse cube silver chlorobromide grains numbered (6) to (10), as shown in Table 5.

Monodisperse cube silver chlorobromide emulsions were also prepared that had the same halogen composition as above by adding dye (a) in an amount $4\times10^{-4}$ mol per mol of the silver halide 1 minute after completion of the grains, and then by desalting. These emulsions were also optimally sensitized chemically to such a degree that fogging was not excessive, and they were numbered (11) to (15).

TABLE 5

| Emulsion | Cl content (%) | Addition of dye before desalting | Grain size (edge length) (μm) | Deviation coefficient |
|---|---|---|---|---|
| 6 | 0 | not made | 0.45 | 0.10 |
| 7 | 30 | not made | 0.44 | 0.10 |
| 8 | 50 | not made | 0.46 | 0.09 |
| 9 | 80 | not made | 0.45 | 0.08 |
| 10 | 100 | not made | 0.45 | 0.08 |
| 11 | 0 | made | 0.45 | 0.10 |
| 12 | 30 | made | 0.44 | 0.10 |
| 13 | 50 | made | 0.46 | 0.09 |
| 14 | 80 | made | 0.45 | 0.08 |
| 15 | 100 | made | 0.45 | 0.08 |

The green-sensitive sensitizing dye (a) mentioned above was added in an amount of $4.0\times10^{-4}$ mol per mol of the silver halide to Emulsions (6) to (10) to prepare green sensitive emulsions, and the green-sensitive emulsions and Emulsions (11) to (15) were combined with the emulsified dispersion shown in Example 1 to prepare coating liquids, thereby forming Samples 6 to 15 the same way as in Example 1. The constitution of the layers and the compositions of the Samples were as shown in Example 1.

After Samples 6 to 15 were exposed to light through a green filter as in Example 1, they were processed with color-developing solution (A).

The results of the photographic performance of Samples 6 to 15 are shown in Table 6.

TABLE 6

| Sample | Green relative sensitivity[1)] | Fogging | γ |
|---|---|---|---|
| 6 (comparative example) | 205 | 0.06 | 1.01 |
| 7 (comparative example) | 145 | 0.07 | 1.08 |
| 8 (comparative example) | 108 | 0.07 | 1.11 |
| 9 (comparative example) | 105 | 0.08 | 1.14 |
| 10 (comparative example) | 100 | 0.10 | 1.28 |
| 11 (comparative example) | 303 | 0.06 | 1.16 |

TABLE 6-continued

| Sample | Green relative sensitivity[1)] | Fogging | γ |
|---|---|---|---|
| 12 (this invention) | 316 | 0.06 | 1.36 |
| 13 (this invention) | 308 | 0.08 | 1.52 |
| 14 (this invention) | 319 | 0.08 | 1.62 |
| 15 (this invention) | 321 | 0.09 | 1.73 |

[1)]The green relative sensitivity of Sample 10 was assumed as 100.

After Samples 6 to 15 were exposed to light the same way as above, they were processed using color-developing solution (A) for 30 sec, 40 sec, and 90 sec respectively to study the progress of the development. The changes in the maximum density Dmax are shown in Table 7.

TABLE 7

| Sample | Dmax Development time (sec) | | |
|---|---|---|---|
| | 30 | 45 | 90 |
| 6 (comparative example) | 1.38 | 2.36 | 2.72 |
| 7 (comparative example) | 1.73 | 2.63 | 2.68 |
| 8 (comparative example) | 2.36 | 2.73 | 2.73 |
| 9 (comparative example) | 2.78 | 2.79 | 2.79 |
| 10 (comparative example) | 2.77 | 2.79 | 2.79 |
| 11 (comparative example) | 1.45 | 2.45 | 2.73 |
| 12 (this invention) | 1.90 | 2.63 | 2.68 |
| 13 (this invention) | 2.40 | 2.75 | 2.75 |
| 14 (this invention) | 2.75 | 2.80 | 2.80 |
| 15 (this invention) | 2.78 | 2.80 | 2.80 |

From Tables 6 and 7 it can be understood that with silver chlorobromide and silver chloride, by adding a dye after the formation of grains but before the desalting, samples that were high in sensitivity and developing speed were obtained, and in samples high in silver chloride content, the effect is remarkable. With the silver bromide emulsions, the extent of the increase in the sensitivity by adding a dye after the formation of grains but before the desalting was low, and the developing speed was low.

EXAMPLE 3

The preparation of Emulsion (1) in Example 1 was repeated, with the temperature and the amount of the silver halide solvent in the third solution controlled, thereby obtaining Emulsions (16) to (18), with the grain size altered as shown in Table 8.

In the preparation of Emulsions (16) to (18), 1 minute after the completion of the addition of the silver nitrate solution and the sodium chloride solution, dyes (e) to (g), shown below, were added to obtain Emulsions (19) to (21) respectively.

Emulsions (16) to (21) were optimally sensitized chemically by adding sodium thiosulfate to such an extent that fogging did not become excessive. The profiles of Emulsions (16) to (21) are shown in Table 8.

TABLE 8

| Emulsion | Addition of dye before desalting | Grain size (edge length) (μm) | Deviation coefficient |
|---|---|---|---|
| 16 | not made | 1.05 | 0.07 |
| 17 | not made | 0.45 | 0.08 |
| 18 | not made | 0.45 | 0.08 |
| 19 | made (e) | 1.04 | 0.07 |
| 20 | made (f) | 0.45 | 0.08 |
| 21 | made (g) | 0.45 | 0.08 |

As spectral-sensitizing dyes, the following dyes were used.

(e) Dye for blue-sensitive emulsion

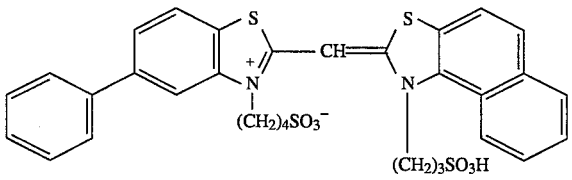

($5.0 \times 10^{-4}$ mol per mol of silver halide)

(f) Dye for green-sensitive emulsion

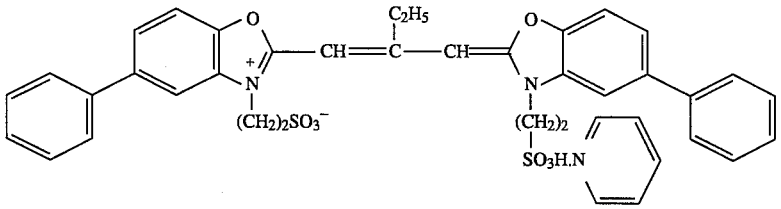

($4.0 \times 10^{-4}$ mol per mol of silver halide)

and

-continued

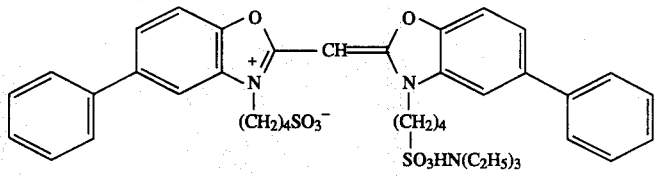

($7.0 \times 10^{-5}$ mol per mol of silver halide)

(g) Dye for red-sensitive emulsion

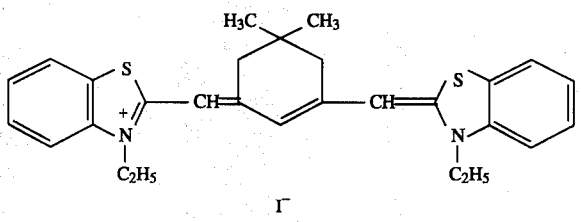

($0.9 \times 10^{-4}$ mol per mol of silver halide)

A multi-layer color photographic paper having a layer constitution as shown in Table 9 was prepared on a two-sided polyethylene-laminated paper base. The coating liquids were prepared as follows.

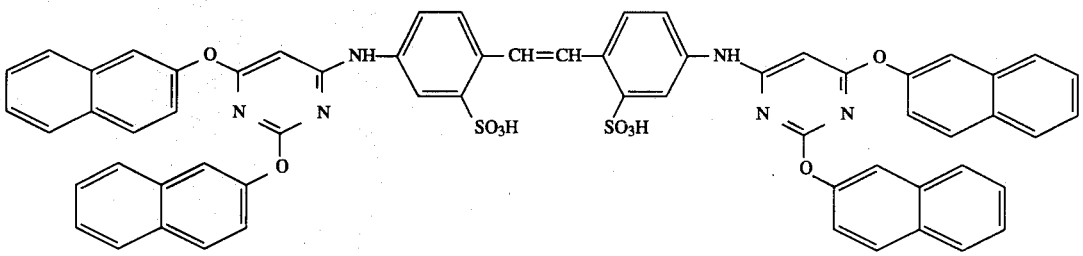

Preparation of a First-layer Coating Liquid 27.2 ml of ethyl acetate and 7.7 ml of a solvent (j) were added to 19.1 g of a yellow coupler (h) and 4.4 g of a color-image stabilizer (i) to dissolve them, and the solution was emulsified and dispersed into 185 ml of a 10% aqueous gelatin solution containing 8 ml of 10% sodium dodecylbenzenesulfonate. On the other hand, the blue-sensitizing dye (e) shown above was added to silver chloride Emulsion (16) (containing 70 g of Ag/kg) in an amount of $5.0\times 10^{-4}$ mol per mol of silver, to obtain an emulsion. This emulsion and the above-emulsified dispersion were mixed and dissolved to prepare a first-layer coating liquid of the composition shown in Table 9. Coating liquids for the second to the seventh layers were prepared in the same manner as for the first-layer coating liquid, except that to prepare the green-sensitive emulsion of the third layer, the green-sensitizing dye (f) mentioned above was added to Emulsion (17), and to prepare the red-sensitive emulsion of the fifth layer, the red sensitive sensitizing dye (g) mentioned above was added to Emulsion (18), respectively in the previously-shown amounts.

As gelatin hardener for the layers, use was made of 1-oxy-3,5-dichloro-s-triazine sodium salt.

To the red-sensitive emulsion layer, the following compound was added in an amount of $2.6\times10^{-3}$ mol per mol the silver halide.

To the blue-sensitive emulsion layer, the green-sensitive emulsion layer, and the red-sensitive emulsion layer, 1-(5-methylureidephenyl)-5-mercaptotetrazole was added respectively in amounts of $8.5\times10^{-5}$ mol, $7.7\times 10^{-4}$mol, and $7.5\times10^{-4}$mol per mol of the silver halide.

To prevent irradiation, the following dye was added to the emulsion layers.

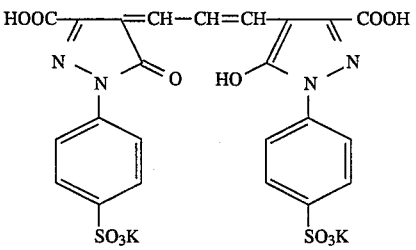
and
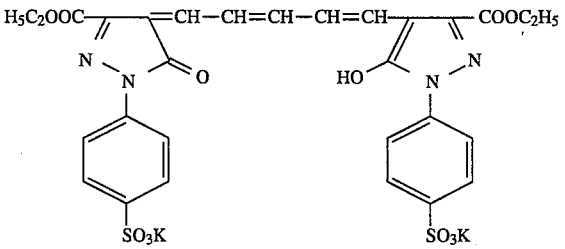
(h) Yellow coupler
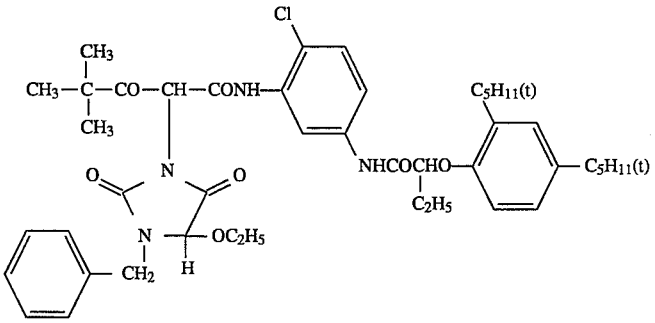
(i) Image-dye stabilizer
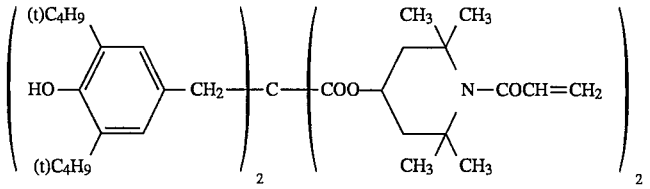
(j) Solvent
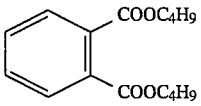
(k) Color-mix inhibitor
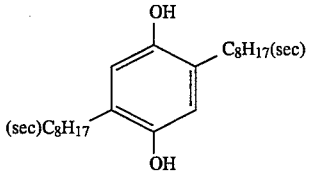
(l) Magenta coupler -continued
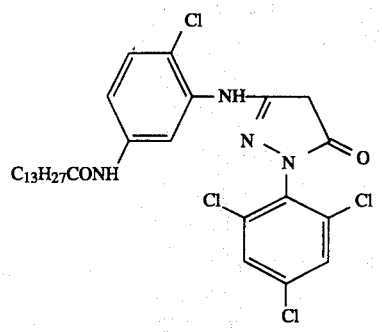
(m) Image-dye stabilizer
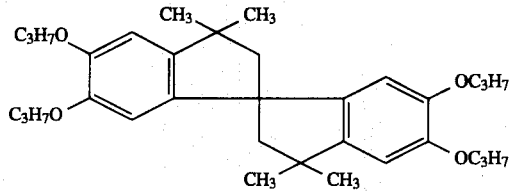
(n) Image-dye stabilizer
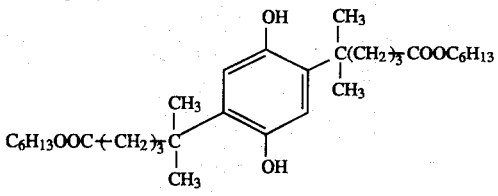
(o) Solvent
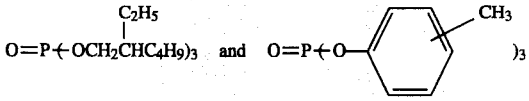
(Mixture of 1:1 in volume ratio)
(p) UV absorber
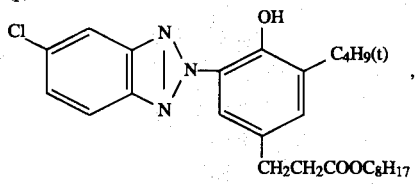
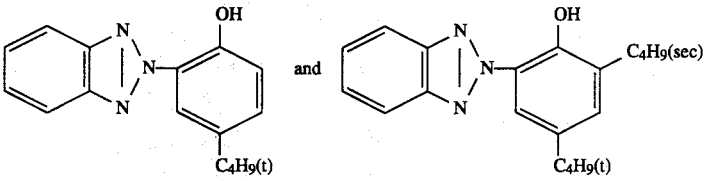
(Mixture of 2:9:8 in weight ratio)
(q) Color-mix inhibitor
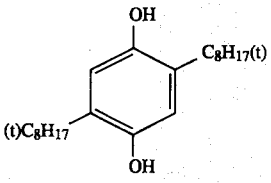
(r) Solvent
$O{=}P{-}(O{-}C_9H_{19}(iso))_3$
(s) Cyan coupler -continued

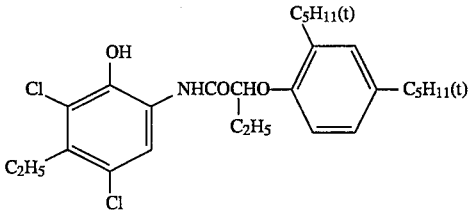

(t) Image-dye stabilizer

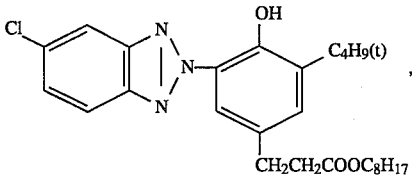

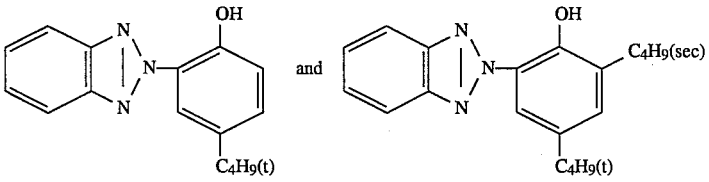

(Mixture of 5:8:9 in weight ratio)

(u) Polymer $\left(CH_2-\underset{\underset{CONHC_4H_9}{|}}{CH}\right)_n$ av. molecular weight 35,000

(v) Solvent

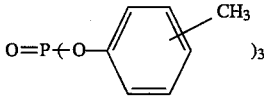

TABLE 9

| Layer | Main Composition | | Coating Amount ($g/m^2$) |
|---|---|---|---|
| Seventh Layer | Gelatin | | 1.33 |
| (Protective | Acryl-modified poly(vinyl alcohol) copolymer | | 0.17 |
| layer) | Liquid paraffin | | 0.03 |
| Sixth Layer | Gelatin | | 0.53 |
| (UV-absorbing | UV absorber (p) | | 0.21 |
| layer) | Solvent (r) | | 0.08 |
| Fifth Layer | Silver halide emulsion | silver: | 0.23 |
| (Red-sensitive | Gelatin | | 1.34 |
| emulsion layer) | Cyan coupler (s) | | 0.34 |
| | Stabilizer (t) | | 0.17 |
| | Polymer (u) | | 0.40 |
| | Solvent (v) | | 0.23 |
| Fourth Layer | Gelatin | | 1.58 |
| (UV-absorbing | UV absorber (p) | | 0.62 |
| layer) | Color-mix inhibitor (q) | | 0.05 |
| | Solvent (r) | | 0.24 |
| Third Layer | Silver halide emulsion | silver: | 0.36 |
| (Green-sensitive | Gelatin | | 1.24 |
| emulsion layer) | Magenta coupler (l) | | 0.31 |
| | Stabilizer (m) | | 0.25 |
| | Stabilizer (n) | | 0.12 |
| | Solvent | | 0.42 |
| Second Layer | Gelatin | | 0.99 |
| (Color-mix | Color-mix inhibitor (k) | | 0.08 |
| inhibiting layer) | | | |
| First Layer | Silver halide emulsion | silver: | 0.30 |
| (Blue-sensitive | Gelatin | | 1.86 |
| emulsion layer) | Yellow coupler (h) | | 0.82 |
| | Stabilizer (i) (i) | | 0.19 |

TABLE 9-continued

| Layer | Main Composition | Coating Amount ($g/m^2$) |
|---|---|---|
| | Solvent (j) | 0.35 |
| Substrate | Polyethylene-laminated paper (A white pigment, $TiO_2$, and a bluish dye, ultramarine, were included in the polyethylene film of the first layer side) | |

The thus-obtained coated sample was designated Sample A. Sample B was prepared in the same way as Sample A, except that instead of Emulsion (16), to which the blue-sensitive sensitizing dye had been added, Emulsion (19), to which the blue-sensitive sensitizing dye had been added before the desalting, was used, and instead of Emulsion (17), to which the green-sensitive sensitizing dye had been added, Emulsion (20), shown in Table 8, was used, and instead of Emulsion (18), to which the red-sensitive sensitizing dye had been added, Emulsion (21), shown in Table 8, was used.

These Samples were subjected to gradation exposure for 0.5 sec using the same sensitometer as in Example 1 through a blue filter, a green filter, and a red filter. Thereafter they were processed with color-developing solution (A) as in Example 1.

The results are shown in Table 10.

TABLE 10

| | Blue exposure | | Green exposure | | Red exposure | |
|---|---|---|---|---|---|---|
| Sample | Relative sensitivity | γ | Relative sensitivity | γ | Relative sensitivity | γ |
| A (comparative example) | 100 | 1.4 | 100 | 1.4 | 100 | 1.3 |
| B (this invention) | 310 | 1.6 | 320 | 1.7 | 270 | 1.6 |

As is shown in Table 10, in Sample B, which used an emulsion to which a spectral-sensitizing dye was added after the formation of grains but before the desalting, a higher sensitivity and a higher gradation were obtained than those of Sample A, and the effect of the present invention was also confirmed for a multi-layer system.

EXAMPLE 4

Example 3 was repeated, except that the green-sensitive emulsion layer (the third layer) in each of Samples A and B were changed as shown below, thereby preparing Samples C and D.

| Main composition of third layer: | | |
|---|---|---|
| Silver halide emulsion | silver: | 0.16 $g/m^2$ |
| Gelatin | | 1.24 $g/m^2$ |
| Magenta coupler (w) | | 0.39 $g/m^2$ |
| Color-image stabilizer (m) | | 0.25 $g/m^2$ |
| Color-image stabilizer (x) | | 0.05 $g/m^2$ |
| Solvent (o) | | 0.42 $g/m^2$ |

The results obtained by exposing and processing Samples C and D as in Example 3 are shown in Table 11. t,1380

TABLE 11

| | Blue exposure | | Green exposure | | Red exposure | |
|---|---|---|---|---|---|---|
| Sample | Relative sensitivity | γ | Relative sensitivity | γ | Relative sensitivity | γ |
| C (comparative example) | 100 | 1.4 | 100 | 1.4 | 100 | 1.3 |
| D (this invention) | 310 | 1.6 | 300 | 1.6 | 270 | 1.6 |

As shown in Table 12, in Sample D, which used an emulsion to which a spectral-sensitizing dye was added after the formation of grains but before the desalting, a higher sensitivity and a higher gradation were obtained than with Sample C.

EXAMPLE 5

Emulsions (1) to (5) were prepared using the same procedure as in Example 1.

Next, in the preparation of Emulsion (4), red-sensitizing dye (g) in the amount of $0.9\times10^{-4}$ mol per mol of the silver halide was added, instead of green-sensitizing dye (a), thereby preparing Emulsion (6).

(g) Dye for red-sensitive emulsion:

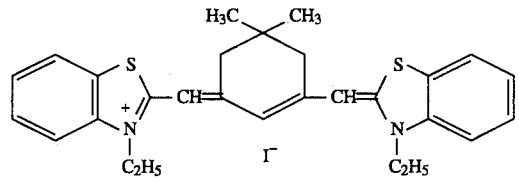

(Amount of addition: $0.9 \times 10^{-4}$ mol per mol of silver halide)

Emulsion (7), which consists of pure silver chloride cubic grains (average grain size of 1.04 μm), was prepared by adjusting the temperature and the volume of the solvent for the silver halide in the third solution as in the preparation of Emulsion (1). Emulsion (8) was prepared by adding blue-sensitizing dye (e) in the amount of 5.0 mol per mol of the silver halide immediately after completion of the addition of the sixth and seventh solutions in the preparation of Emulsion (7).

(e) Dye for blue-sensitive emulsion:

-continued

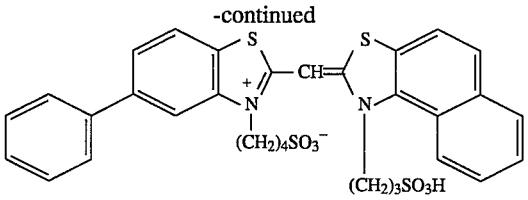

(Amount of addition: $5.0 \times 10^{-4}$ mol per mol of silver halide)

The above-mentioned emulsions (6) to (8) were optimally sensitized chemically by adding sodium thiosulfate.

TABLE 12

| Emulsion | Dye added | Time of Addition | Grain Size (Edge-length) (μm) | Deviation coefficient |
|---|---|---|---|---|
| 1 | — | — | 0.45 | 0.08 |
| 2 | a | 5 min. before completion of addition of 6th and 7th solutions | 0.44 | 0.23 |
| 3 | a | 1 min. before completion of addition of 6th and 7th solutions | 0.45 | 0.08 |
| 4 | a | Immediately after completion of addition of 6th and 7th solutions | 0.45 | 0.08 |
| 5 | a | After desalting and before chemically sensitizing | 0.44 | 0.07 |
| 6 | g | Immediately after completion of addition of 6th and 7th solutions | 0.45 | 0.08 |
| 7 | — | — | 1.04 | 0.07 |
| 8 | e | Immediately after completion of addition of 6th and 7th solutions | 1.04 | 0.07 |

A multi-layer color photographic paper (Sample A) consisting of layers as shown in Table 9 (Example 3) was prepared on a two-side polyethylene-laminated paper base. The coating liquids were prepared as shown below.

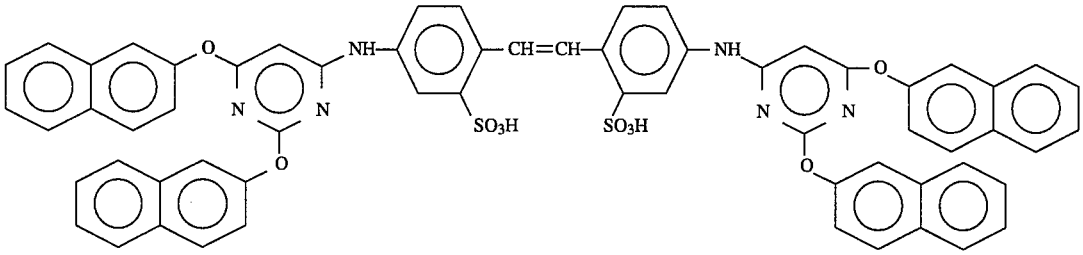

Preparation of the First-layer Coating Liquid

To 19.1 g of a yellow coupler (h) and 4.4 g of a color-image stabilizer (i) were added 27.2 ml of ethyl acetate and 7.7 ml of a solvent (j), and they were mixed until dissolved. The resulting solution was dispersed and emulsified in 185 ml of a 10% aqueous gelatin solution containing 8 ml of 10% sodium dodecylbenzenesulfate. On the other hand, the above-shown blue-sensitizing dye (e) was added to the silver chloride emulsion (7)(containing 70 g of Ag per kg) in an amount of $5.0\times10^{-4}$ mol per mol of silver, to obtain an emulsion. This emulsion and the above emulsified-dispersion were mixed and dissolved to prepare the first-layer coating liquid, of the composition shown in Table 9 of Example 3. Coating liquids for the second to the seventh layers were prepared by the same procedure as the first-layer coating liquid, except that to prepare the green-sensitive emulsion of the third layer, the above-mentioned green-sensitizing dye (a) was added to Emulsion (1) in an amount of $4.0\times10^{-4}$ mol per mol of the silver halide, and to prepare the red-sensitive emulsion of the fifth layer, the above-mentioned red-sensitizing dye (g) was added to Emulsion (1) in an amount of $0.9\times10^{-4}$ mol per mol of the silver halide.

The compounds used were the same as in Example 3.

As a gelatin hardener for the respective layers, 1-oxy-3, 5-dichloro-s-triazine sodium salt was used.

To the red-sensitive emulsion layer, the following compound was added in an amount of $2.6\times10^{-3}$ mol per mol of the silver halide.

To the blue-, green-, and red-sensitive layers, 1-( 5-methylureidephenyl)-5-mercaptotetrazole was added respectively in the amounts of $8.5\times10^{-5}$, $7.7\times10^{-4}$ , and $7.5\times10^{-4}$ mol per mol of the silver halide.

Next Sample B was prepared using the same procedure as for Sample A, except for the addition of the t5 following dye 1 into the green-sensitive emulsion layer and the following dye 2 into the red-sensitive layer.

Dye 1

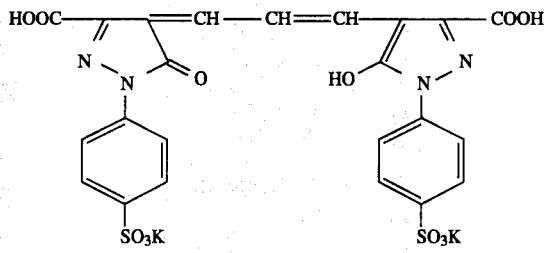

(Amount of addition: $2\times10^{-5}$ mol/m$^2$)

Dye 2

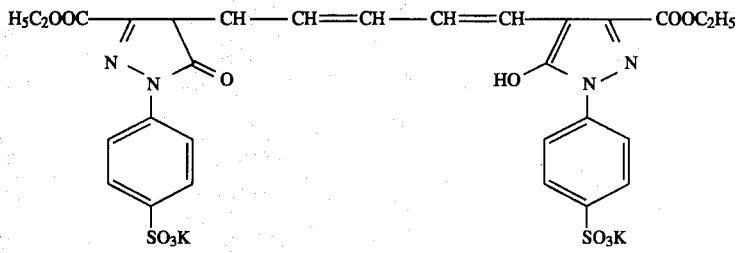

(Amount of addition: $2\times10^{-5}$ mol/m$^2$)

Then Samples C to H were prepared by changing the emulsion of each layer in Sample B to those shown in Table 13. However, for emulsions such as (2), (3), (4), (5), (6) and (8), to which had been added a sensitizing dye at the formation of grains and before chemical ripening, the corresponding sensitizing dye was not added in the preparation of the coating liquid.

The samples shown in Table 13 were subjected to gradation exposure for 10 sec (corresponding to 250 CMS of exposure) using the same sensitometer as in Example 1 through a blue filter, a green filter, and a red filter.

Thereafter they were processed according to the steps shown below. Each used the same processing solution as in Example 1.

| Processing Steps | Temperature | Time |
|---|---|---|
| Color development (by Solution-A) | 35° C. | 45 sec. |
| Bleach-fixing (by Solution-A) | 35° C. | 45 sec. |
| Rinsing | 28 to 35° C. | 90 sec. |

The results are shown in Table 3. Herein the term "relative sensitivity" means the relative value of the sensitivity designated by a reciprocal of the amount of light exposure at the lowest density +5 on the characteristic curve of the color image exposed to light at 25° C. and 55% rh, with Sample A assumed as 100. The gradation $\gamma$ is given by the density difference between the above sensitivity point and the point increased by 0.5 in terms of the logarithm (log E) of the exposure quantity.

The term "desensitivity" means the difference of relative sensitivities when the photographic material is exposed to light under conditions of 25° C./55% rh. and 25° C./85% rh.

The sharpness is a quantity indicating the clearness of the outline of an image and the ability to depict fine images, and herein the value called CTF was used. CTF is given in terms of % by the damping factor of the amplitude against the spatial frequency as a square waveform. In Table 3, sharpness in 15 spatial frequencies/mm is shown. The greater the value, the higher the sharpness.

TABLE 13

| | | | | | B | | | | G | | | | R | | | |
|---|---|---|---|---|---|---|---|---|---|---|---|---|---|---|---|---|
| | Addition | Emulsion | | | Relative Sensi- | | Desensi- | Sharp- | Relative Sensi- | | Desensi- | Sharp- | Relative Sensi- | | Desensi- | Sharp- |
| Sample | of Dye | B | G | R | tivity | $\gamma$ | tivity | ness | tivity | $\gamma$ | tivity | ness | tivity | $\gamma$ | tivity | ness |
| A | not made | 7 | 1 | 1 | 100 | 1.4 | 36 | 21 | 100 | 1.5 | 33 | 26 | 100 | 1.3 | 30 | 25 |
| B | made | 7 | 1 | 1 | 66 | 1.4 | 46 | 22 | 35 | 1.5 | 42 | 30 | 33 | 1.3 | 38 | 33 |
| C | made | 7 | 2 | 1 | 66 | 1.4 | 46 | 22 | 88 | 1.0 | 36 | 30 | 33 | 1.3 | 38 | 33 |
| D* | made | 7 | 3 | 1 | 66 | 1.4 | 46 | 22 | 112 | 1.7 | 36 | 30 | 33 | 1.3 | 38 | 33 |
| E* | made | 7 | 4 | 1 | 66 | 1.4 | 46 | 22 | 103 | 1.6 | 37 | 30 | 33 | 1.3 | 38 | 33 |
| F | made | 7 | 5 | 1 | 66 | 1.4 | 46 | 22 | 60 | 1.4 | 40 | 30 | 33 | 1.3 | 38 | 33 |

TABLE 13-continued

| | | | | | B | | | | G | | | | R | | | |
|---|---|---|---|---|---|---|---|---|---|---|---|---|---|---|---|---|
| Sample | Addition of Dye | Emulsion B | Emulsion G | Emulsion R | Relative Sensitivity | γ | Desensitivity | Sharpness | Relative Sensitivity | γ | Desensitivity | Sharpness | Relative Sensitivity | γ | Desensitivity | Sharpness |
| G | not made | 8 | 4 | 6 | 310 | 1.6 | 32 | 21 | 290 | 1.6 | 31 | 26 | 270 | 1.6 | 29 | 25 |
| H* | made | 8 | 4 | 6 | 204 | 1.6 | 36 | 22 | 105 | 1.6 | 37 | 30 | 90 | 1.6 | 33 | 33 |

*This Invention

From Table 3 it can be understood that samples D and E, consisting of green-sensitive emulsion layers of the present invention, and sample H, consisting of blue-, green-, and red-sensitive emulsion layers of the present invention, are not only high in sensitivity and gradation, they are also excellent in sharpness and low in change in sensitivity due to a change in humidity when exposed, as compared to samples that do not contain the emulsion and/or the dye of the present invention.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide color photographic paper having on a reflective base at least one blue light sensitive photosensitive emulsion layer, at least one green light sensitive photosensitive emulsion layer, and at least one red light sensitive photosensitive emulsion layer containing a silver halide emulsion having a silver chloride content of 95 mol % or more, said blue light or green light sensitive photosensitive emulsion layers containing a silver halide photographic emulsion, which comprises:

a silver halide photographic emulsion containing silver chlorobromide including a silver chloride in an amount of 95 mol % or more but substantially free from silver iodide and prepared by the steps comprising forming silver halide grains in the presence of a hydrophilic colloid, physical ripening, desalting, and chemical ripening, and adding (i) a photographic blue spectral-sensitizing dye of formula (VII) to said blue light sensitive photosensitive emulsion layer, (ii) adding a photographic green spectral sensitizing dye of formula (VIII) to said green light sensitive photosensitive emulsion layer, or (iii) adding said blue spectral-sensitizing dye of formula (VII) to said blue light sensitive photosensitive emulsion layer and adding a photographic green spectral-sensitizing dye of formula (VIII) to said green light sensitive photosensitive emulsion layer, said blue and green spectral-sensitizing dyes each being added in an amount in the range of $1.0\times10^{-6}$ to $1.0\times10^{-2}$ mol per mol of silver halide after the addition of at least 85 wt. % of a soluble silver salt solution, required for formation of the silver halide grains, but during the time silver halide grains are being formed;

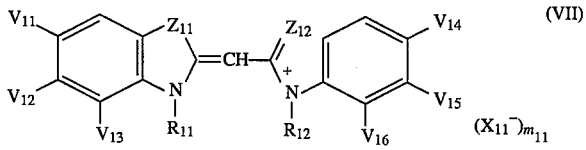

(VII)

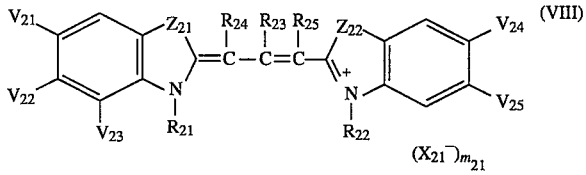

(VIII)

wherein in formula (VII), $Z_{11}$ represents an oxygen atom or a sulfur atom; $Z_{12}$ represents a sulfur atom or an oxygen atom; $R_{11}$ and $R_{12}$, which may be the same or different, each represents an optionally substituted alkyl group or alkenyl group containing up to 6 carbon atoms, with at least one of $R_{11}$ and $R_{12}$ being a sulfo-substituted alkyl group; when $Z_{11}$ represents an oxygen atom, $V_{11}$ and $V_{13}$ each represents a hydrogen atom, and $V_{12}$ represents a phenyl group or a phenyl group substituted by an alkyl group or an alkoxy group containing up to 3 carbon atoms or a chlorine atom; when $Z_{11}$ represents a sulfur atom, $V_{11}$ represents an alkyl group or an alkoxy group containing up to 4 carbon atoms or a hydrogen atom, $V_{12}$ represents an alkyl group containing up to 5 carbon atoms, an alkoxy group containing up to 4 carbon atoms, a chlorine atom, a hydrogen atom, an optionally substituted a hydroxy group, and $V_{13}$ represents a hydrogen atom; $X_{11}$ represents a counter ion which is required to neutralize a charge on a cyanine dye of formulas (VII) or (VIII); $m_{11}$ represents 0 or 1, and in the case of forming an inner salt, $m_{11}$ represents 1; $V_{14}$ represents hydrogen or methyl, $V_{15}$ represents hydrogen, chlorine or methyl, and $V_{16}$ represents hydrogen; and wherein in formula (VIII), $Z_{21}$ represents an oxygen atom, and $Z_{22}$ represents an oxygen atom; $R_{21}$ and $R_{22}$ are the same as defined for $R_{11}$ or $R_{12}$ in general formula (VII); $R_{23}$ represents an ethyl group, a propyl group or a butyl group; $R_{24}$ and $R_{25}$ each represents a hydrogen atom; $V_{21}$ represents a hydrogen atom;

$V_{22}$ represents a hydrogen atom, an alkyl group containing up to 5 carbon atoms, an alkoxy group containing up to 5 carbon atoms, a chlorine atom or an optionally substituted phenyl group; $V_{23}$ represents hydrogen or $V_{22}$ may be bonded to $V_{21}$ or $V_{23}$ to form a fused benzene ring when $Z_{21}$ represents an oxygen atom, or $V_{22}$ represents an optionally substituted phenyl group or may be linked to $V_{21}$ or $V_{23}$ to form a fused benzene ring when $Z_{21}$ and $Z_{22}$ both represent an oxygen atom; $V_{24}$ represents a hydrogen atom; $V_{25}$ represents an alkoxy group containing up to 4 carbon atoms, a chlorine atom or an optionally substituted phenyl group or may be bonded to $V_{24}$ or $V_{26}$ to form a fused benzene ring; $V_{26}$ represents a hydrogen atom; $X_{21}$ represents a counter ion which is required to neutralize a charge on a cyanine dye of formula (VII) or (VIII); $m_{21}$ represents 0 or 1 and, when an inner salt is formed, $m_{21}$ represents 0; and said silver halide photographic emulsion further containing at least one compound represented by the formula (I), (II), or (III):

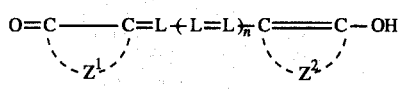

wherein $Z^1$ and $Z^2$, which may be the same or different, each represent a group of nonmetal atoms required to form a heterocyclic ring, L represents a methine group in which L and L may connect each other to form a ring, and n is 0, 1, or 2,

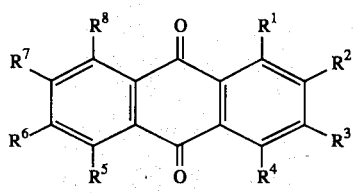

wherein $R^1$, $R^4$, $R^5$ and $R^8$, which may be the same or different, each represent a hydrogen atom, a hydroxy group, an alkoxy group, an aryloxy group, a carbamoyl group, or an amino group represented by

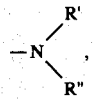

in which R' and R", which may be the same or different, each represent a hydrogen atom, or an aryl or an alkyl group, having at least one sulfonic acid group or a carboxylic acid group, $R^2$, $R^3$, $R^6$, and $R^7$, which may be the same or different, each represent a hydrogen atom, a sulfonic acid group, a carboxyl group or an aryl or an alkyl group, having at least one sulfonic group or a carboxyl group, (A)

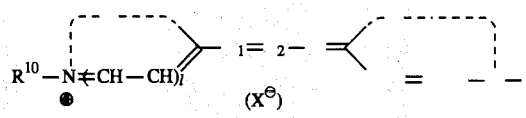

(B)

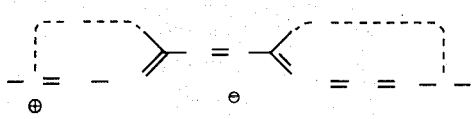

wherein $R^{10}$ and $R^{11}$, which may be the same or different, each represent an alkyl group, $L_1$, $L_2$, and $L_3$, which may be the same or different, each represent a methine group, m is 0, 1, 2, or 3, $L_1$ and $R^{10}$, $L_3$ and $R^{11}$, $L_2$ and $L_2$ when m is 2, and $L_1$ and $L_1$ when m is 3, may connect each other to form a ring, Z and Z', which may be the same or different, each represent a group of nonmetal atoms required for forming a heterocyclic 5- or 6-membered ring, and l and n each are 0 or 1, $X^{\ominus}$ represents an anion, and p is 1 or 2, provided that when the compound forms an inner salt, p is 1.

2. The silver halide photographic material as claimed in claim 1, wherein the spectral-sensitizing dye is selected from the compounds represented by (A) or (B) of formula (III):

Formula (III)

(A)

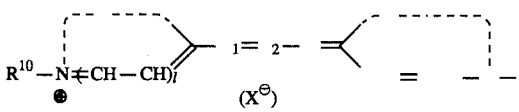

(B)

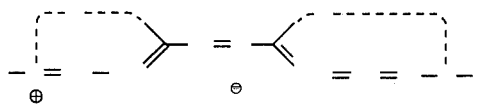

wherein $R^{10}$ and $R^{11}$ which may be the same or different, each represent an alkyl group, $L_1$, $L_2$, and $L_3$, which may be the same or different, each represent a methine group, m is 0, 1, 2, or 3, $L_1$and $R^{10}$ , $L_2$ and $R^{11}$, $L_2$ and $L_2$ when m is 2, and $L_1$ and $L_1$ when m is 3, may connect each other to form a ring, Z and Z' which may be the same or different, each represent a group of nonmetal atoms required for forming a heterocyclic 5- or 6-membered ring, and l and n each are 0 or 1, $x^{\ominus}$ represents an anion, and p is 1 or 2, provided that when the compound forms an inner salt, p is 1.

3. The silver halide photographic material as claimed in claim 1, wherein the spectral-sensitizing dye is selected from the compound represented by formula (C):

Formula (C)

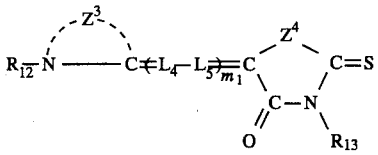

wherein $R_{12}$ represents an alkyl group, $R_{13}$ represents an alkyl group, a hydrogen atom, a furfuryl group, or a single ring-aryl group, $Z^3$ represents a group of nonmetal atoms required to form a 5- or 6-membered heterocyclic ring, $Z^4$ represents a sulfur atom, an oxygen atom, a selenium atom, or

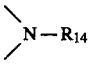

wherein $R_{14}$ represents a hydrogen atom, a pyridyl group, a phenyl group, a substituted phenyl group, or an aliphatic hydrocarbon group having carbon atoms of 8 or less, which may contain an oxygen atom, a sulfur atom, or a nitrogen atom in the carbon chain and may have a substituent, $L_4$ and $L_5$ each represent a methine group, and $m_1$ is 0, 1, or 2.

4. The silver halide photographic material as claimed in claim 1, wherein the amount of the spectral-sensitizing dye is in the range of $1.0\times10^{-5}$ to $1.0\times10^{-3}$ per mol of a silver halide.

5. The silver halide photographic material as claimed in claim 1, wherein the coating amount of the compounds represented by formulae (I), (II), and (III) is in the range of $1\times10^{-6}$ to $2\times10^{-4}$ mol/m$^2$.

6. The silver halide photographic material as claimed in claim 1, wherein the deviation coefficient of the silver halide grains in the silver halide emulsion is 0.22 or less.

7. The silver halide photographic material as claimed in claim 6, wherein the deviation coefficient of the silver halide grains in the silver halide emulsion is 0.15 or less.

8. The silver halide photographic material as claimed in claim 7, wherein the silver halide photographic emulsion is a mixed emulsion each having the grain size distribution of 0.15 or less in terms of the deviation coefficient.

9. The silver halide photographic material as claimed in claim 6, wherein the silver halide emulsion comprises regular shaped silver halide grains.

10. The silver halide photographic material as claimed in claim 1, which contains a compound having the formula F-I-12

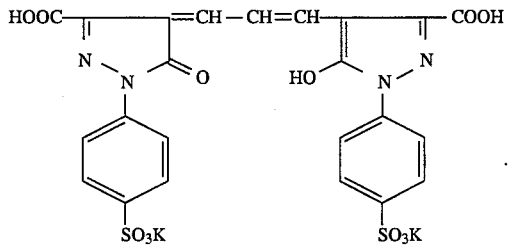

11. The silver halide photographic material as claimed in claim 1, wherein in formula (I), said heterocyclic rings are selected from the group consisting of a 5-pyrazolone ring, barbituric acid, isooxazolone, thiobarbituric acid, rhodanine, imidazopyridine, pyrazolopyridine and pyrrolidone.

12. The silver halide photographic material as claimed in claim 1, wherein for $R^1$, $R^4$, $R^5$ and $R^8$ of formula (II), said alkoxy group has 1 to 4 carbon atoms and said aryloxy group has 6 to 10 carbon atoms.

13. The silver halide photographic material as claimed in claim 1, wherein for R', R", $R^2$, $R^3$, $R^6$ and $R^7$ of formula (II), said aryl group has 6 to 10 carbon atoms and said alkyl group has 1 to 4 carbon atoms.

14. The silver halide photographic material as claimed in claim 1, wherein the photographic blue spectral sensitizing dye of formula (VII) is added to said blue light sensitive photosensitive emulsion layer.

15. The silver halide photographic material as claimed in claim 1, wherein the photographic green spectral sensitizing dye of formula (VIII) is added to said green light sensitive photosensitive emulsion layer.

16. The silver halide photographic material as claimed in claim 1, wherein the blue spectral sensitizing dye of formula (VII) is added to said blue light sensitive photosensitive emulsion layer and a photographic green spectral sensitizing dye of formula (VIII) is added to said green light sensitive photosensitive emulsion layer.

17. A silver halide color photographic paper having on a reflective base at least one blue light sensitive photosensitive emulsion layer, at least one green light sensitive photosensitive emulsion layer, and at least one red light sensitive photosensitive emulsion layer containing a silver halide emulsion having a silver chloride content of 95 mol % or more, said blue light or green light sensitive photosensitive emulsion layers containing a silver halide photographic emulsion, which comprises:

a silver halide photographic emulsion containing silver chlorobromide including a silver chloride in an amount of 95 mol % or more but substantially free from silver iodide and prepared by the steps comprising forming silver halide grains in the presence of a hydrophilic colloid, physical ripening, desalting, and chemical ripening, and adding (i) a photographic blue spectral-sensitizing dye of formula (VII) to said blue light sensitive photosensitive emulsion layer, (ii) adding a photographic green spectral sensitizing dye of formula (VIII) to said green light sensitive photosensitive emulsion layer, or (iii) adding said blue spectral-sensitizing dye of formula (VII) to said blue light sensitive photosensitive emulsion layer and adding a photographic green spectral-sensitizing dye of formula (VIII) to said green light sensitive photosensitive emulsion layer, said blue and green spectral-sensitizing dyes each being added in an amount in the range of $1.0\times10^{-6}$ to $1.0\times10^{-2}$ mol per mol of silver halide after the addition of at least 85 wt. % of a soluble silver salt solution, required for formation of the silver halide grains, but during the time silver halide grains are being formed;

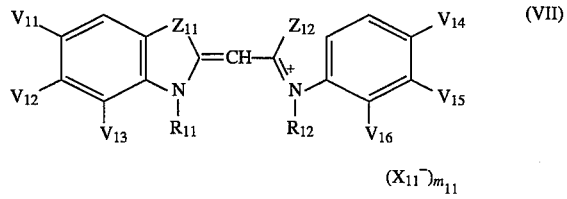

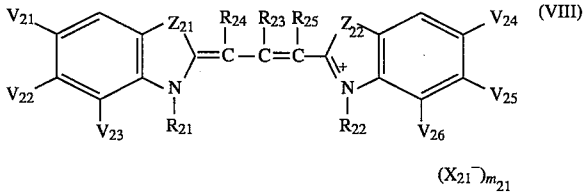

wherein in formula (VII), $Z_{11}$ represents an oxygen atom or a sulfur atom; $Z_{12}$ represents a sulfur atom or an oxygen atom; $R_{11}$ and $R_{12}$, which may be the same or different, each represents an optionally substituted alkyl group or alkenyl group containing up to 6 carbon atoms, with at least one of $R_{11}$ and $R_{12}$ being a sulfo-substituted alkyl group; when $Z_{11}$ represents an oxygen atom, $V_{11}$ and $V_{13}$ each represents a hydrogen atom, and $V_{12}$ represents a phenyl group or a phenyl group substituted by an alkyl group or an alkoxy group containing up to 3 carbon atoms or a chlorine atom; when $Z_{12}$ represents a sulfur atom, $V_{14}$ represents a hydrogen atom, an alkoxy group containing up to 4 carbon atoms or an alkyl group containing up to 5 carbon atoms, $V_{15}$ represents an alkoxy group containing up to 4 carbon atoms, an optionally substituted phenyl group, an alkyl group containing up to 4 carbon atoms, a chlorine atom or a hydroxyl group, and $V_{16}$ represents a hydrogen atom; when $Z_{11}$ represents a sulfur atom, $V_{11}$ represents an alkyl group or an alkoxy group containing up to 4 carbon atoms or a hydrogen atom, $V_{12}$ represents an alkyl group containing up to 5 carbon atoms, an alkoxy group containing up to 4 carbon atoms, a chlorine atom, a hydrogen atom, an optionally substituted a hydroxy group, and $V_{13}$ represents a hydrogen atom; $X_{11}$ represents a counter ion which is required to neutralize a charge on a cyanine dye of formulas (VII) or (VIII); $m_{11}$ represents 0 or 1, and in the case of forming an inner salt, $m_{11}$ represents 1; $V_{14}$ represents hydrogen or methyl, $V_{15}$ represents hydrogen, chlorine or methyl, and $V_{16}$ represents hydrogen; and wherein in formula (VIII), $Z_{21}$ represents an oxygen atom, and $Z_{22}$ represents an oxygen atom; $R_{21}$ and $R_{22}$ are the same as defined for $R_{11}$ or $R_{12}$ in general formula (VII); $R_{23}$ represents an ethyl group, a propyl group or a butyl group; $R_{24}$ and $R_{25}$ each represents a hydrogen atom; $V_{21}$ represents a hydrogen atom; $V_{22}$ represents a hydrogen atom, an alkyl group containing up to 5 carbon atoms, an alkoxy group containing up to 5 carbon atoms, a chlorine atom or an optionally substituted phenyl group; $V_{23}$ represents hydrogen or $V_{22}$ may be bonded to $V_{21}$ or $V_{23}$ to form a fused benzene ring when $Z_{21}$ represents an oxygen atom, or $V_{22}$ represents an optionally substituted phenyl group or may be linked to $V_{21}$ or $V_{23}$ to form a fused benzene ring when $Z_{21}$ and $Z_{22}$ both represent an oxygen atom; $V_{24}$ represents a hydrogen atom; $V_{25}$ represents an alkoxy group containing up to 4 carbon atoms, a chlorine atom or an optionally substituted phenyl group or may be bonded to $V_{24}$ or $V_{26}$ to form a fused benzene ring; $V_{26}$ represents a hydrogen atom; $X_{21}$ represents a counter ion which is required to neutralize a charge on a cyanine dye of formula (VII) or (VIII); $m_{21}$ represents 0 or 1 and, when an inner salt is formed, $m_{21}$ represents 0; and said silver halide photographic emulsion further containing at least one compound represented by the formula (I), (II), or (III):

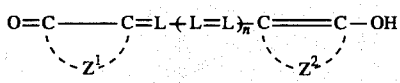

Formula (I)

wherein $Z^1$ and $Z^2$, which may be the same or different, each represent a group of nonmetal atoms required to form a heterocyclic ring, L represents a methine group in which L and L may connect each other to form a ring, and n is 0, 1, or 2,

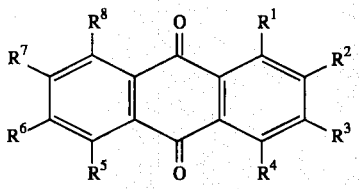

Formula (II)

wherein $R^1$, $R^4$, $R^5$ and $R^8$, which may be the same or different, each represent a hydrogen atom, a hydroxy group, an alkoxy group, an aryloxy group, a carbamoyl group, or an amino group represented by

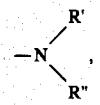

in which R' and R", which may be the same or different, each represent a hydrogen atom, or an aryl or an alkyl group, having at least one sulfonic acid group or a carboxylic acid group, $R^2$, $R^3$, $R^6$, and $R^7$, which may be the same or different, each represent a hydrogen atom, a sulfonic acid group, a carboxyl group or an aryl or an alkyl group, having at least one sulfonic group or a carboxyl group,

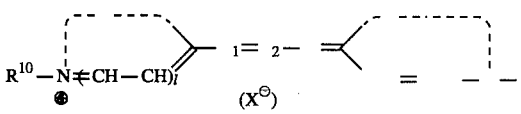

(A)

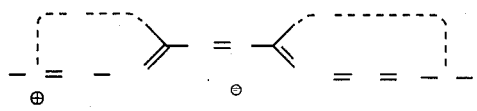

(B)

wherein $R^{10}$ and $R^{11}$, which may be the same or different, each represent an alkyl group, $L_1$, $L_2$, and $L_3$, which may be the same or different, each represent a methine group, m is 0, 1, 2, or 3, $L_1$ and $R^{10}$, $L_3$ and $R^{11}$, $L_2$ and $L_2$ when m is 2, and $L_1$ and $L_1$ when m is 3, may connect each other to form a ring, Z and Z', which may be the same or different, each represent a group of nonmetal atoms required for forming a heterocyclic 5- or 6-membered ring, and l and n each are 0 or 1, $X^{\ominus}$ represents an anion, and p is 1 or 2, provided that when the compound forms an inner salt, p is 1.

18. A silver halide color photographic paper having on a reflective base at least one blue light sensitive photosensitive emulsion layer, at least one green light sensitive photosensitive emulsion layer, and at least one red light sensitive photosensitive emulsion layer containing a silver halide emulsion having a silver chloride content of 95 mol % or more, said blue light or green light sensitive photosensitive emulsion layers containing a silver halide photographic emulsion, which comprises:

a silver halide photographic emulsion containing silver chlorobromide including a silver chloride in an amount of 95 mol % or more but substantially free from silver iodide and prepared by the steps comprising forming silver halide grains in the presence of a hydrophilic colloid, physical ripening, desalting, and chemical ripening, and adding (i) a photographic blue spectral-sensitizing dye of formula (VII) to said blue light sensitive photosensitive emulsion layer, (ii) adding a photographic green spectral sensitizing dye of formula (VIII) to said green light sensitive photosensitive emulsion layer, or (iii) adding said blue spectral-sensitizing dye of formula (VII) to said blue light sensitive photosensitive emulsion layer and adding a photographic green spectral-sensitizing dye of formula (VIII) to said green light sensitive photosensitive emulsion layer, said blue and green spectral-sensitizing dyes each being added in an amount in the range of $1.0\times10^{-6}$ to $1.0\times10^{-2}$ mol per mol of silver halide after the addition of at least 85 wt. % of a soluble silver salt solution, required for formation of the silver halide grains, but during the time silver halide grains are being formed;

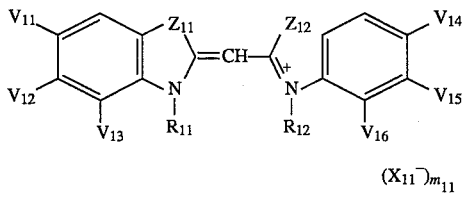

(VII)

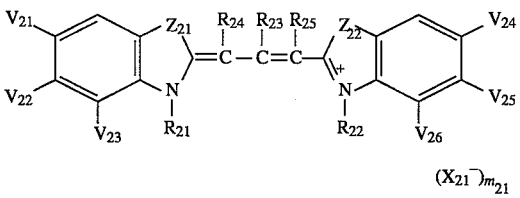

(VIII)

wherein in formula (VII), $Z_{11}$ represents an oxygen atom or a sulfur atom; $Z_{12}$ represents a sulfur atom or an oxygen atom; $R_{11}$ and $R_{12}$, which may be the same or different, each represents an optionally substituted alkyl group or alkenyl group containing up to 6 carbon atoms, with at least one of $R_{11}$ and $R_{12}$ being a sulfo-substituted alkyl group; when $Z_{11}$ represents an oxygen atom, $V_{11}$ and $V_{13}$ each represents a hydrogen atom, and $V_{12}$ represents a phenyl group or a phenyl group substituted by an alkyl group or an alkoxy group containing up to 3 carbon atoms or a chlorine atom; when $Z_{11}$ represents a sulfur atom, $V_{11}$ represents an alkyl group or an alkoxy group containing up to 4 carbon atoms or a hydrogen atom, $V_{12}$ represents an alkyl group containing up to 5 carbon atoms, an alkoxy group containing up to 4 carbon atoms, a chlorine atom, a hydrogen atom, an optionally substituted phenyl group or a hydroxy group, and $V_{13}$ represents a hydrogen atom; $X_{11}$ represents a counter ion which is required to neutralize a charge on a cyanine dye of formulas (VII) or (VIII); $m_{11}$ represents 0 or 1, and in the case of forming an inner salt, $m_{11}$ represents 1; $V_{14}$ and $V_{16}$ each represents a hydrogen atom, $V_{15}$ represents an alkoxy group containing up to 4 carbon atoms, hydrogen, phenyl, a chlorine atom or a phenyl group; and wherein in formula (VIII), $Z_{21}$ represents an oxygen atom, and $Z_{22}$ represents an oxygen atom; $R_{21}$ and $R_{22}$ are the same as defined for $R_{11}$ or $R_{12}$ in general formula (VII); $R_{23}$ represents an ethyl group, a propyl group or a butyl group; $R_{24}$ and $R_{25}$ each represents a hydrogen atom; $V_{21}$ represents a hydrogen atom;

$V_{22}$ represents a hydrogen atom, an alkyl group containing up to 5 carbon atoms, an alkoxy group containing up to 5 carbon atoms, a chlorine atom or an optionally substituted phenyl group; $V_{23}$ represents hydrogen or $V_{22}$ may be bonded to $V_{21}$ or $V_{23}$ to form a fused benzene ring when $Z_{21}$ represents an oxygen atom, or $V_{22}$ represents an optionally substituted phenyl group or may be linked to $V_{21}$ or $V_{23}$ to form a fused benzene ring when $Z_{21}$ and $Z_{22}$ both represent an oxygen atom; $V_{24}$ represents a hydrogen atom; $V_{25}$ represents an alkoxy group containing up to 4 carbon atoms, a chlorine atom or an optionally substituted phenyl group or may be bonded to $V_{24}$ or $V_{26}$ to form a fused benzene ring; $V_{26}$ represents a hydrogen atom; $X_{21}$ represents a counter ion which is required to neutralize a charge on a cyanine dye of formula (VII) or (VIII); $m_{21}$ represents 0 or 1 and, when an inner salt is formed, $m_{21}$ represents 0; and said silver halide photographic emulsion further containing at least one compound represented by the formula (I), (II), or (III):

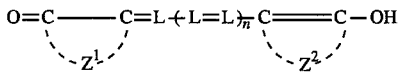

Formula (I)

wherein $Z^1$ and $Z^2$, which may be the same or different, each represent a group of nonmetal atoms required to form a heterocyclic ring, L represents a methine group in which L and L may connect each other to form a ring, and n is 0, 1, or 2,

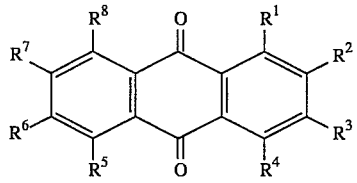

Formula (II)

wherein $R^1$, $R^4$, $R^5$ and $R^8$, which may be the same or different, each represent a hydrogen atom, a hydroxy group, an alkoxy group, an aryloxy group, a carbamoyl group, or an amino group represented by

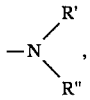

in which R' and R", which may be the same or different, each represent a hydrogen atom, or an aryl or an alkyl group, having at least one sulfonic acid group or a carboxylic acid group, $R^2$, $R^3$, $R^6$, and $R^7$, which may be the same or different, each represent a hydrogen atom, a sulfonic acid group, a carboxyl group or an aryl or an alkyl group, having at least one sulfonic group or a carboxyl group, Formula (III)

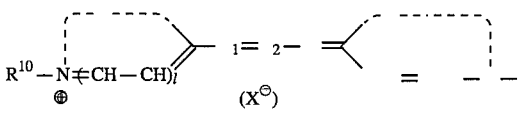

(A)

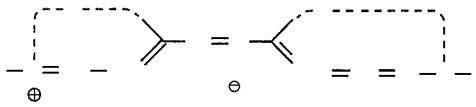

(B)

wherein $R^{10}$ and $R^{11}$, which may be the same or different, each represent an alkyl group, $L_1$, $L_2$, and $L_3$, which may be the same or different, each represent a methine group, m is 0, 1, 2, or 3, $L_1$ and $R^{10}$, $L_3$ and $R^{11}$, $L_2$ and $L_2$ when m is 2, and $L_1$ and $L_1$ when m is 3, may connect each other to form a ring, Z and Z', which may be the same or different, each represent a group of nonmetal atoms required for forming a heterocyclic 5- or 6-membered ring, and l and n each are 0 or 1, $X^{\ominus}$ represents an anion, and p is 1 or 2, provided that when the compound forms an inner salt, p is 1.

* * * * *